US008649696B2

(12) United States Patent
Takemura

(10) Patent No.: US 8,649,696 B2
(45) Date of Patent: Feb. 11, 2014

(54) IMAGE FORMING APPARATUS INCLUDING AN IMAGE AREA GLOSSINESS CONTROL FEATURE

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 13/004,342

(22) Filed: Jan. 11, 2011

(65) Prior Publication Data

US 2011/0182607 A1 Jul. 28, 2011

(30) Foreign Application Priority Data

Jan. 22, 2010 (JP) ..... 2010-011753

(51) Int. Cl.
*G03G 15/20* (2006.01)

(52) U.S. Cl.
USPC ..... 399/67; 399/39

(58) Field of Classification Search
USPC ..... 399/39, 67
See application file for complete search history.

(56) References Cited

U.S. PATENT DOCUMENTS

| | | | | |
|---|---|---|---|---|
| 5,234,783 | A * | 8/1993 | Ng | 430/45.53 |
| 7,991,328 | B2 | 8/2011 | Masui | |
| 8,086,161 | B2 | 12/2011 | Omata | |
| 8,150,280 | B2 | 4/2012 | Omata | |
| 8,175,499 | B2 | 5/2012 | Masui | |
| 2005/0135851 | A1 * | 6/2005 | Ng et al. | 399/341 |
| 2006/0140677 | A1 | 6/2006 | Fukatsu et al. | |
| 2008/0160435 | A1 | 7/2008 | Lim et al. | |
| 2008/0298860 | A1 | 12/2008 | Omata | |
| 2009/0034998 | A1 | 2/2009 | Omata | |
| 2009/0087221 | A1 | 4/2009 | Masui | |
| 2009/0238616 | A1 | 9/2009 | Ciaschi | |
| 2009/0286177 | A1 | 11/2009 | Tyagi et al. | |
| 2011/0236043 | A1 | 9/2011 | Masui | |
| 2012/0014702 | A1 | 1/2012 | Takemura | |

FOREIGN PATENT DOCUMENTS

| | | | |
|---|---|---|---|
| JP | 2002-318482 | A | 10/2002 |
| JP | 2006-209090 | A | 8/2006 |
| JP | 2006-251722 | A | 9/2006 |
| JP | 2009-031511 | A | 2/2009 |
| JP | 2009-058941 | A | 3/2009 |
| JP | 2009-80436 | A | 4/2009 |
| RU | 2008 122 299 | A | 12/2009 |

OTHER PUBLICATIONS

Notification of the First Office Action dated Jun. 13, 2012, in Chinese Application No. 201110024663.3.

(Continued)

*Primary Examiner* — Ryan Walsh
(74) *Attorney, Agent, or Firm* — Fitzpatrick, Cella, Harper & Scinto

(57) ABSTRACT

An image forming apparatus includes a color toner image forming portion for forming a toner image with a color toner on a recording material; a clear toner image forming portion for forming a toner image with a clear toner on the recording material, wherein the clear toner has a melt viscosity, at a fixing temperature, higher than that of the color toner; a fixing device for fixing the toner image formed on the recording material; an obtaining portion for obtaining information on an area in which designated glossiness is partly increased, partly decreased, or partly increased and decreased; and a control device for determining the order of formation of the toner image with the color toner and the toner image with the clear toner on the recording material depending on the information obtained by the obtaining portion.

12 Claims, 14 Drawing Sheets

(56) References Cited

OTHER PUBLICATIONS

Official Action dated Mar. 5, 2012, in Russian Application No. 2011102343/28(003151).

Communication dated Apr. 6, 2011, forwarding a European Search Report dated Mar. 28, 2011, in counterpart European Application No. 11151536.7-1240.

Decision on Grant dated Aug. 24, 2012, in Russian Application No. 2011102343/28(003151).

Office Action mailed Jan. 23, 2013, in Korean Application No. 10-2011-0006315.

Korean Office Action dated Oct. 25, 2013, in related Korean Patent Application No. 10-2011-006315.

* cited by examiner (a)

(b)

IMAGE FORMING APPARATUS INCLUDING AN IMAGE AREA GLOSSINESS CONTROL FEATURE

FIELD OF THE INVENTION AND RELATED ART

The present invention relates to an image forming apparatus, such as a printer or a copying machine, capable of effective image formation by color toner and clear toner (transparent toner).

In recent years, an electrophotographic apparatus using the clear toner has been proposed. Various manners of representation can be realized by using the clear toner, so that added value of an output product is improved. Examples of an image forming method using the clear toner may include a method in which a color toner image and a clear toner image are successively formed on a recording material and then are fixed at one time. Further, as described in Japanese Laid-Open Patent Application (JP-A)2002-318482 and JP-A 2006-251722, a two-time fixing method in which the color toner image is formed and once fixed on the recording material and thereon the clear toner image is formed and then fixed may also be included.

On the other hand, as a using method of the clear toner, first, gloss impartment or uniform glossing at an image portion may be employed. The glossiness (gloss) of the surface of the output product (surface of image formed product to be outputted) may preferably be uniform at the whole surface. Further, with respect to a graphic image or the like, a higher glossy image is preferred. However, in an electrophotographic type, the glossiness of an output image is not uniform in many cases. For example, toner is not placed on a white background portion and therefore the surface glossiness of paper which is the recording material is outputted as it is, so that resultant glossiness is always constant. On the other hand, at a highlight portion, the toner image is formed in a fine dot shape to provide projections and recesses, so that the glossiness is lowered. Further, at a solid image portion, the toner sufficiently covers the surface of the paper to smoothen the surface, so that the glossiness is increased. Therefore, the entire image has non-uniform glossiness, so that an image quality is lowered. In this case, the entire surface of the paper is covered with the clear toner and then is subjected to fixation, so that uniform glossiness is obtained from the white background portion to the solid image portion. In the case where a further high-gloss image is obtained, high glossiness is obtained by increasing heat quantity to be applied to the paper by the fixation to sufficiently melt the toner or by decreasing a melt viscosity of the clear toner.

As the other using method of the clear toner, a using method in which the image is represented by a mark with the clear toner which is called a watermark, an eye-catch or a security mark may be employed. It is preferable that such a mark with the clear toner can be freely selected depending on a purpose in a manner that the mark is made conspicuous or inconspicuous by intention of a user from high glossiness to low glossiness.

However, such a mark with the clear toner may desirably be, together with the intention to make the mark conspicuous or inconspicuous, selectable to the extent that the glossiness of the mark is higher or lower than that of its adjacent portion. With respect to the intention to provide the mark with the glossiness higher or lower than that of the adjacent portion, e.g., it would be considered that a method in which a plurality of clear toners different in glossiness are provided is employed. However, in this case, there arises a problem such that a new manufacturing line is needed or a resultant apparatus is complicated.

On the other hand, in order to effect partial glossiness control, a method in which the image partly increased in glossiness or the image partly decreased in glossiness are outputted by subjecting the image to the fixation once to twice has also been proposed. However, there is a need to subject the image to the fixation twice, so that productivity is lowered. Further, in the case where the method as described above is used, it becomes possible to effect wide gloss control. However, a means (method) for obtaining such an output product that an area in which the glossiness is partly decreased relative to the glossiness of an adjacent portion and an area in which the glossiness is partly increased relative to the glossiness of the adjacent portion are co-present in the same plane of a single output product has not yet been proposed.

SUMMARY OF THE INVENTION

The present invention has been accomplished in view of the circumstances as described above.

A principal object of the present invention is to provide an image forming apparatus, in which an image is formed by using color toners and one species of clear toner, capable of obtaining an output product as described above without lowering productivity by using the clear toner. That is, a specific object of the present invention is to provide an image forming apparatus capable of obtaining an output product which has been subjected to wide glossiness control such that an area in which glossiness is partly decreased relative to glossiness of an adjacent portion, an area in which the glossiness is partly increased relative to the glossiness of the adjacent portion, or an area in which both of the areas are co-present is present in the same plane (surface) of the output product.

According to an aspect of the present invention, there is provided an image forming apparatus comprising:

- color toner image forming means for forming a toner image with a color toner on a recording material;
- clear toner image forming means for forming a toner image with a clear toner on the recording material, wherein the clear toner has a melt viscosity, at a fixing temperature, higher than that of the color toner;
- fixing means for fixing the toner image formed on the recording material;
- obtaining means for obtaining information on an area in which designated glossiness is partly increased, partly decreased, or partly increased and decreased; and
- control means for determining the order of formation of the toner image with the color toner and the toner image with the clear toner on the recording material depending on the information obtained by the obtaining means.

These and other objects, features and advantages of the present invention will become more apparent upon a consideration of the following description of the preferred embodiments of the present invention taken in conjunction with the accompanying drawings.

Figure 3:
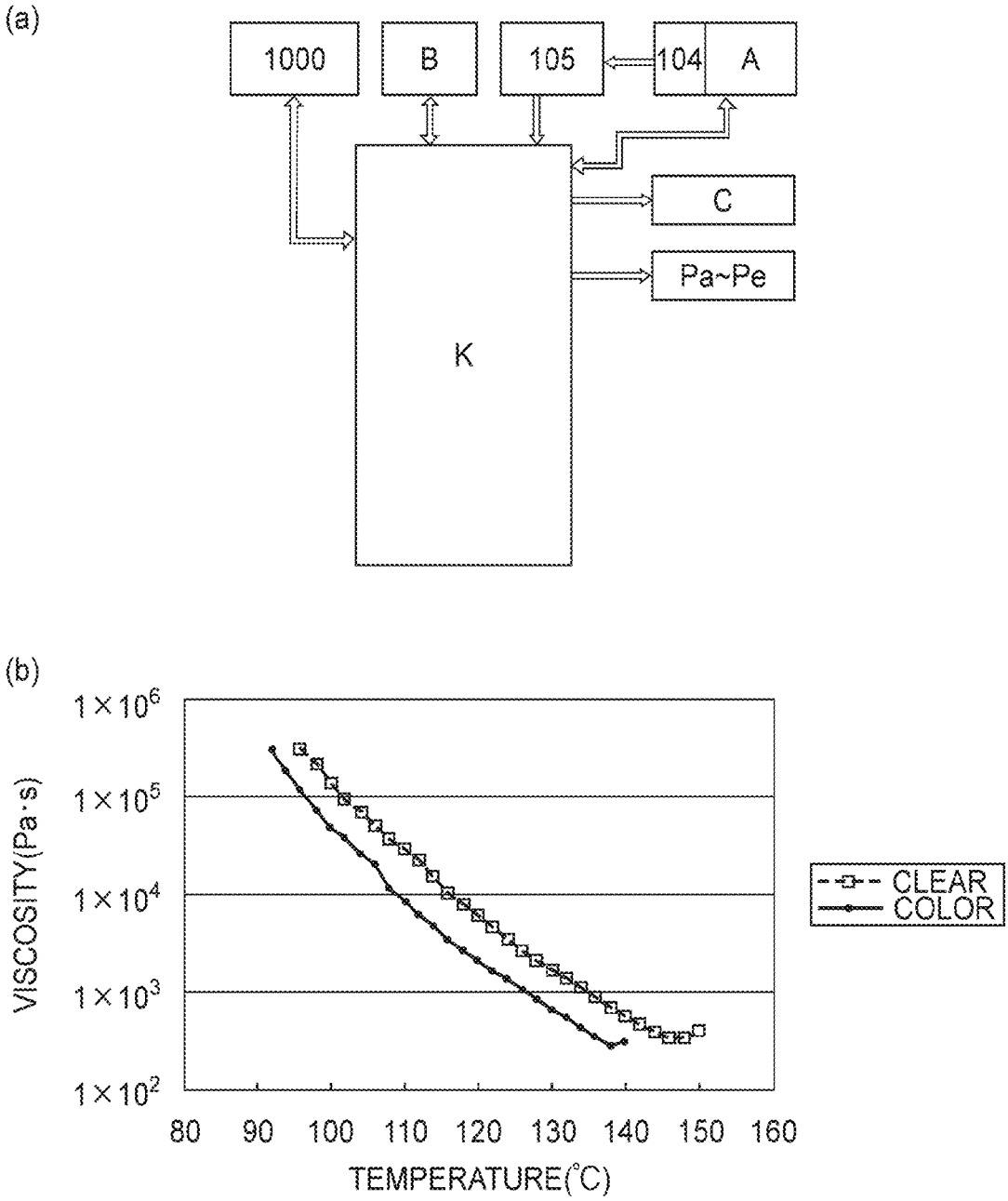

Part (a) of FIG. 3 is a schematic block diagram of a control system, and (b) is a graph showing a melt viscosity characteristic of color toner and clear toner used in Embodiment 1.

Figure 4:
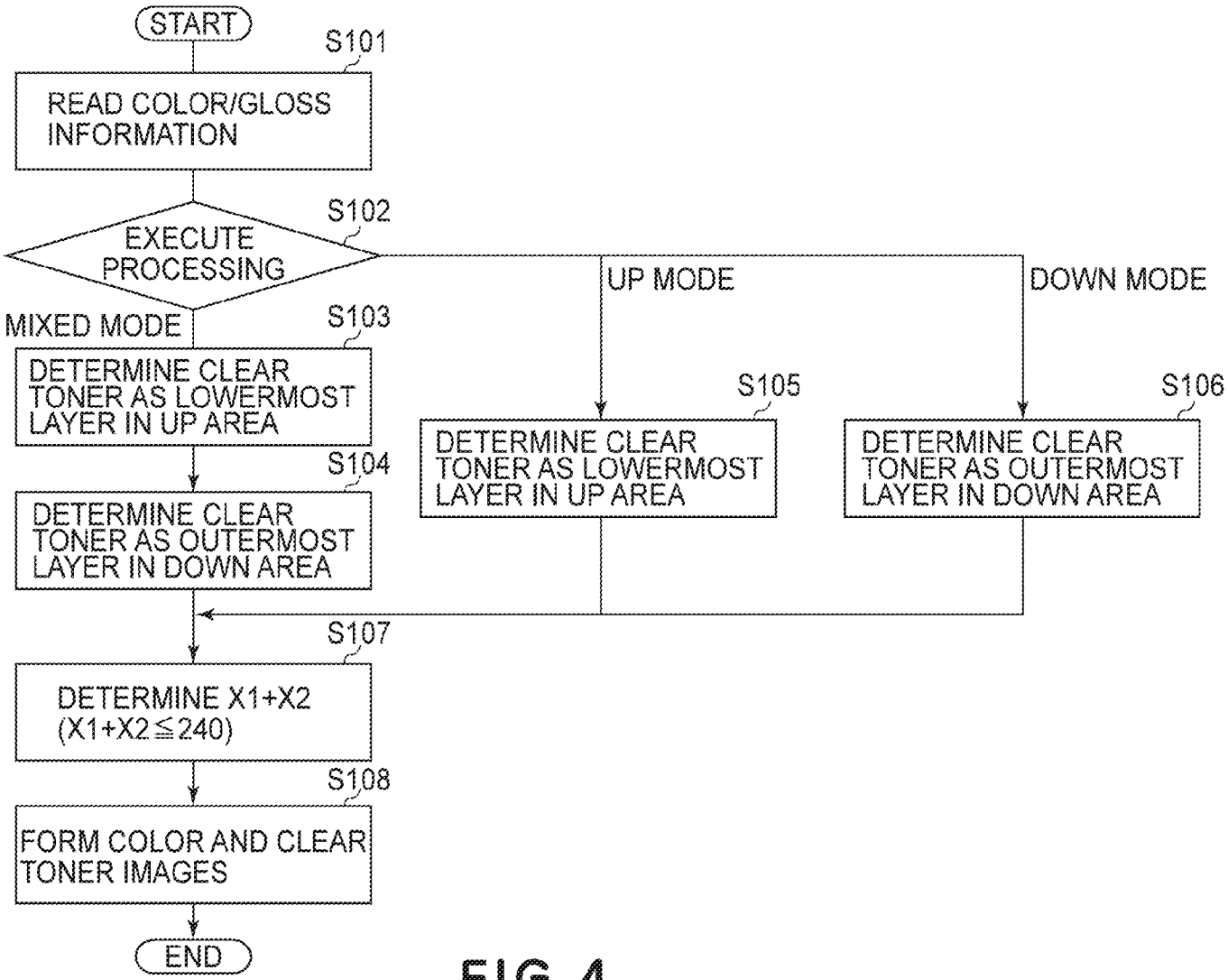

FIG. 4 is a control flow chart during selection of a glossing (gloss processing) mode in Embodiment 1.

Figure 5:
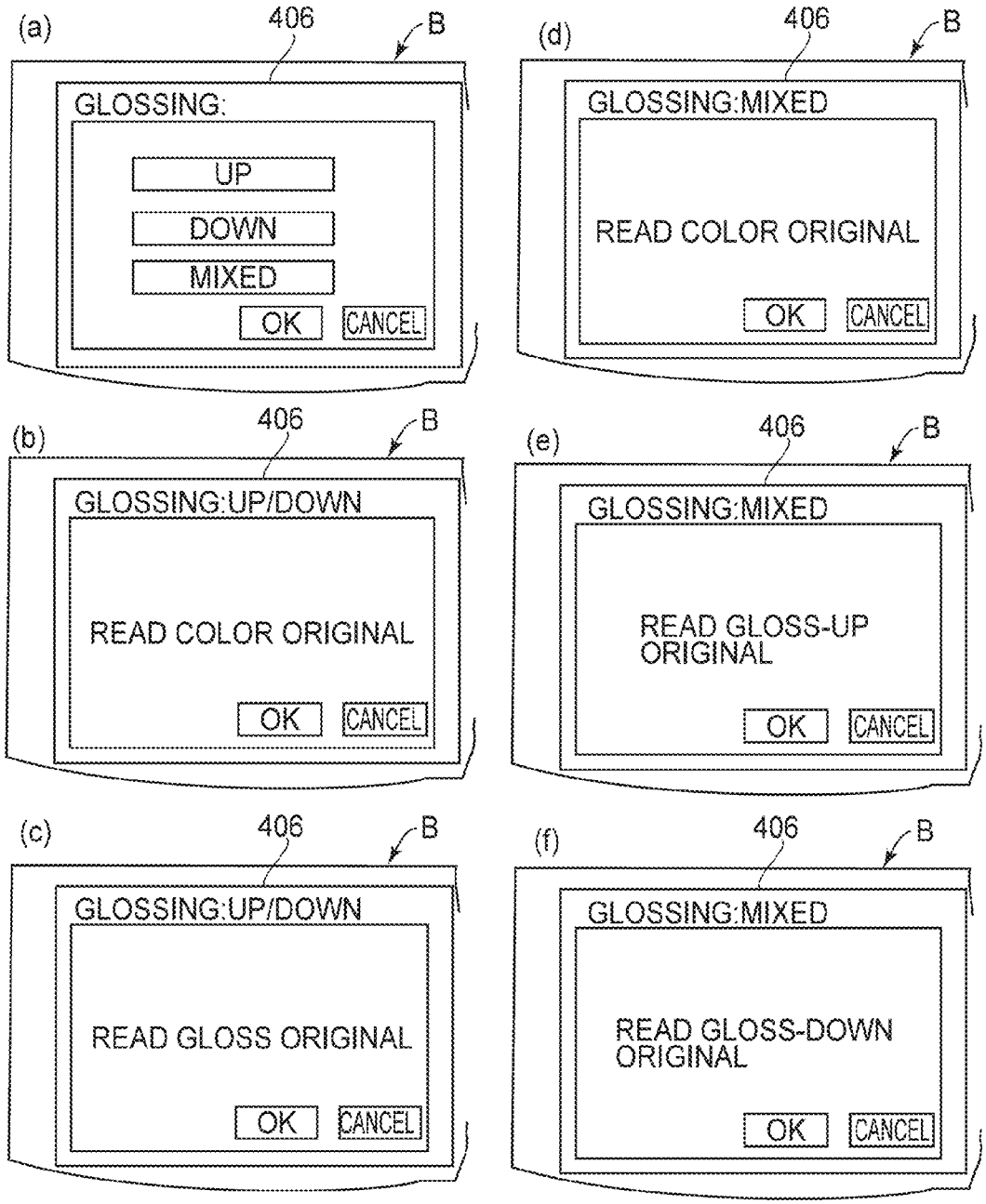

Part (a) of FIG. 5 is a designation screen of the operation display portion during the selection of the glossing mode, (b) is a designation screen for reading a color original in gloss-up correction or gloss-down correction, (c) is a designation screen for reading a gloss original (d) is a designation screen for reading the color original in mixed gloss correction, (e) is a designation screen for reading a gloss original for gloss up in the mixed gloss correction, and (f) is a designation screen for reading the gloss original for gloss down in the mixed gloss correction.

Figure 6:
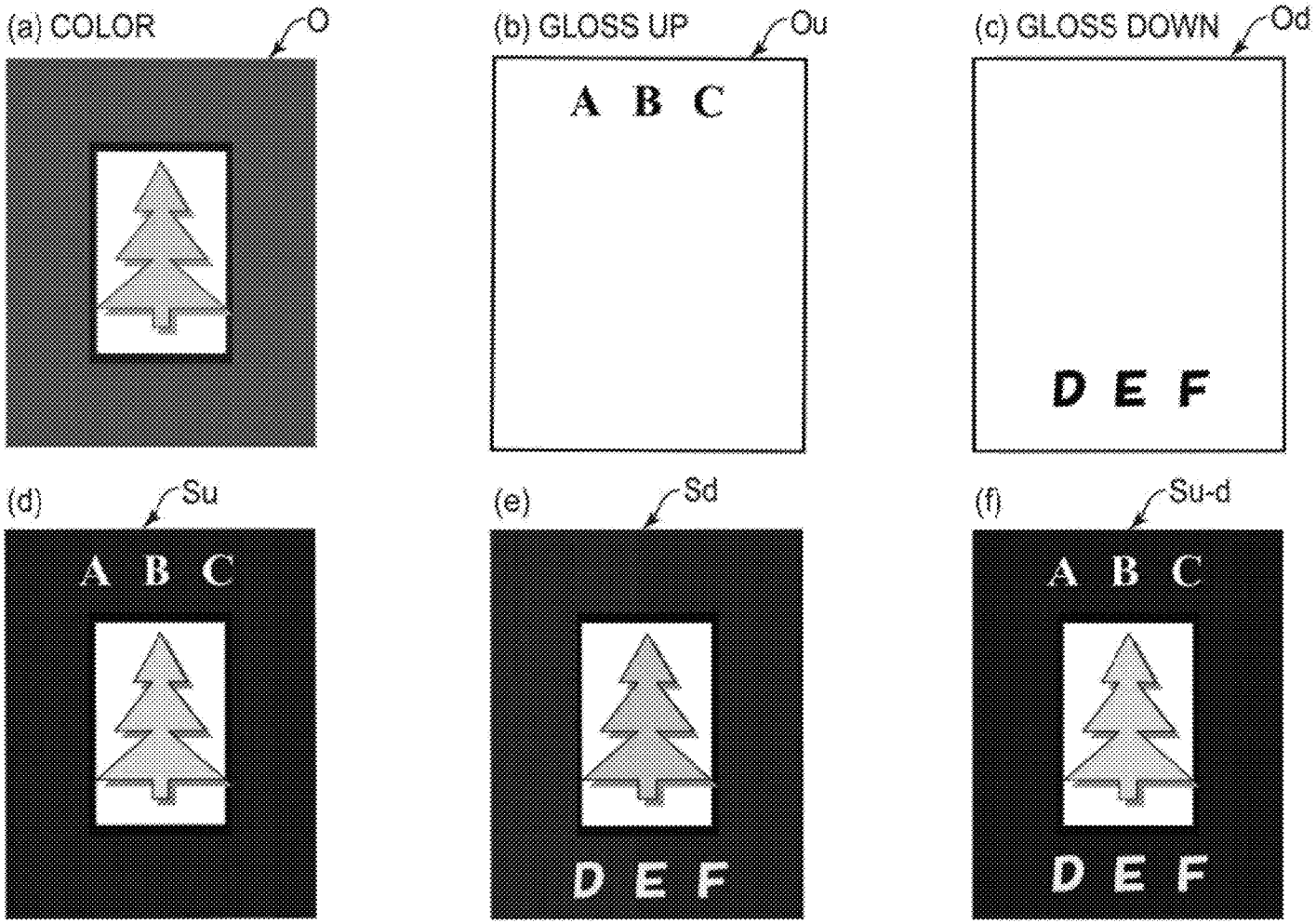

Part (a) of FIG. 6 is an example of a color original image in Embodiment 1, (b) is an example of a gloss original image for gloss up, (c) is a gloss original image for gloss down, (d) is an example of an image of a gloss-up output product, (e) is an example of an image of a gloss-down output product, and (f) is an example of an image of a mixed gloss output product.

Figure 7:
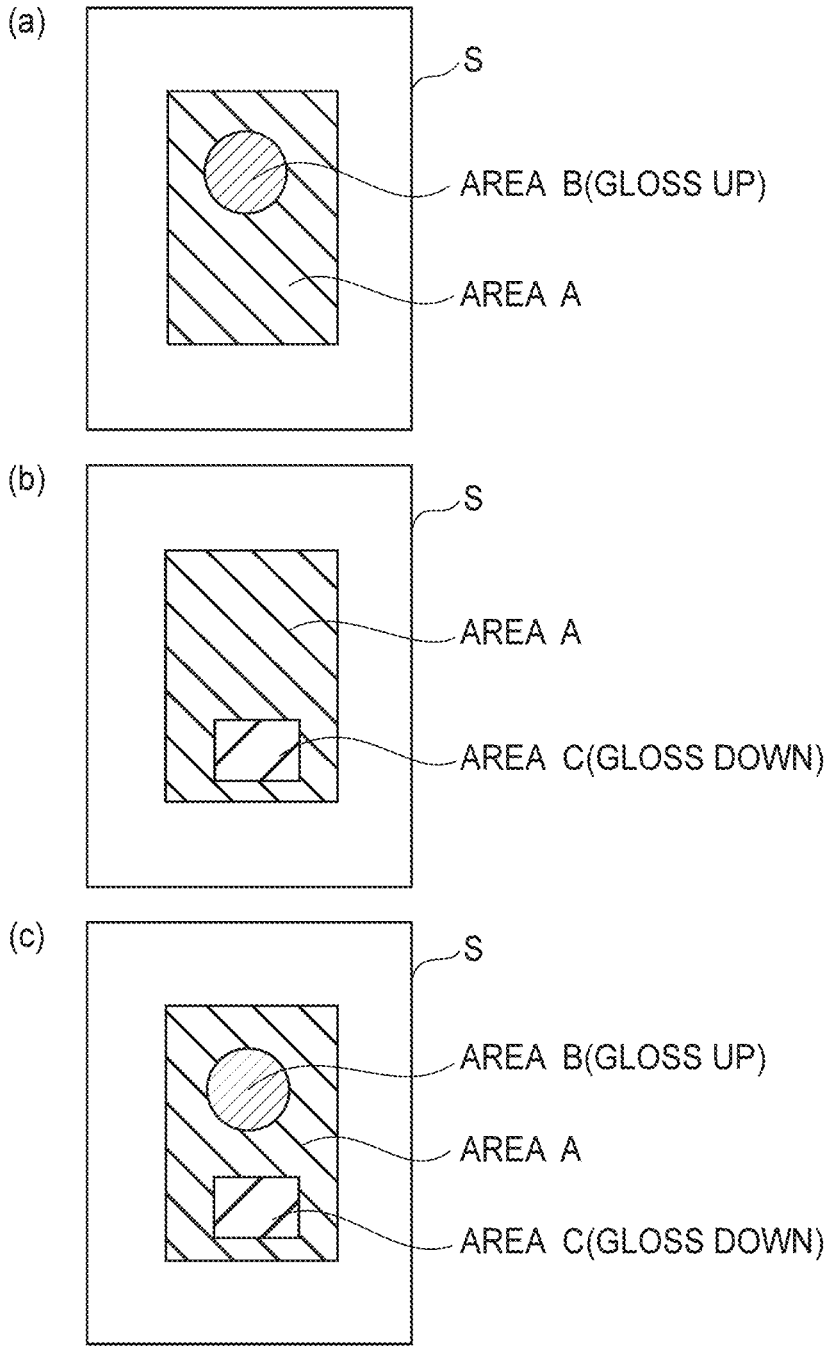

Part (a) of FIG. 7 is a schematic view of an example of an image formed state in a gloss-up mode, (b) is a schematic view of an example of an image formed state in a gloss-down mode, and (c) is a schematic view of an example of an image formed state in a mixed gloss mode.

Figure 8:
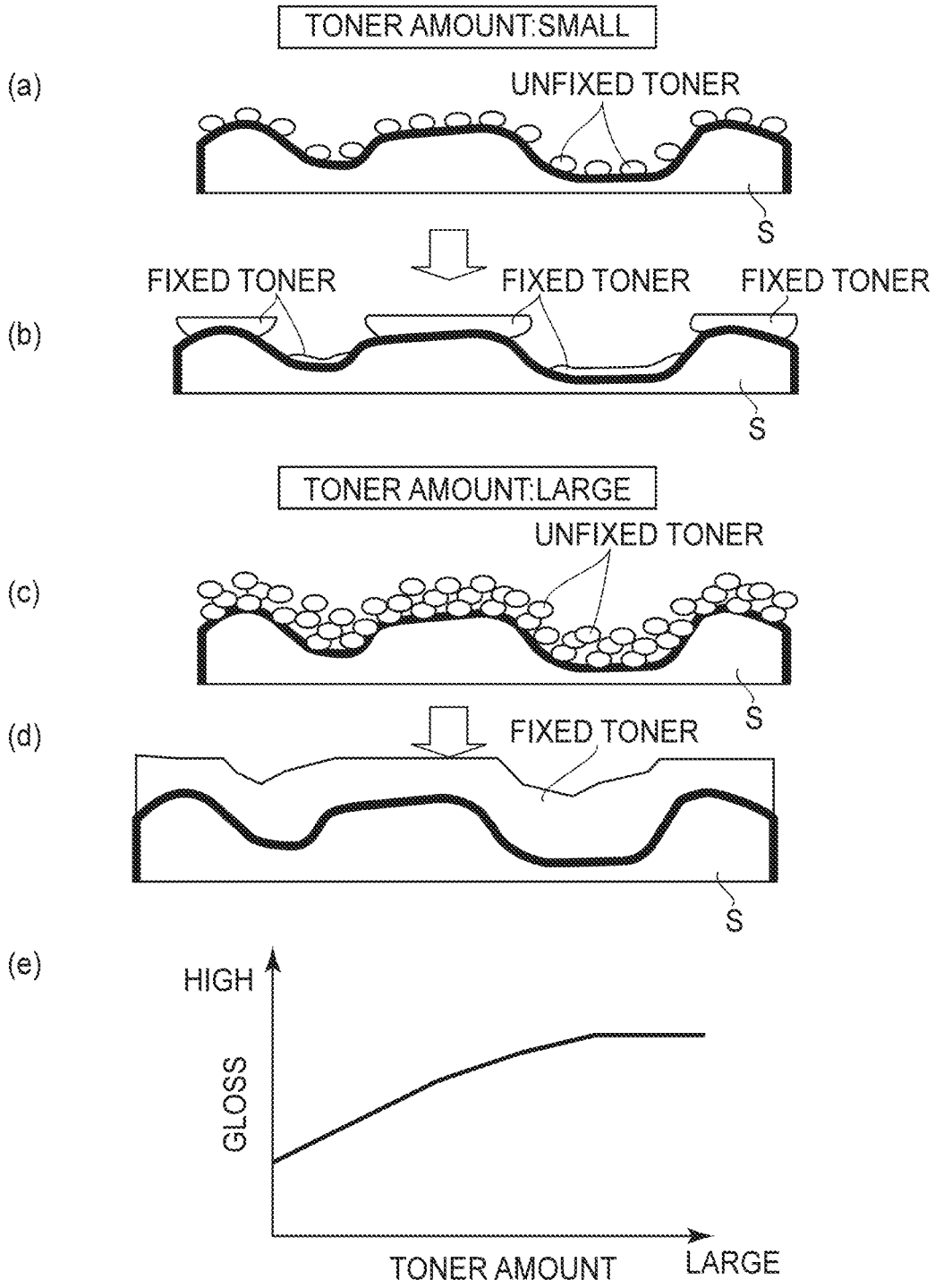

Parts (a) and (b) of FIG. 8 are schematic views showing an unfixed toner state and a melted state, respectively, on a recording material in the case where a toner amount is small, (c) and (d) are schematic views showing the unfixed toner state and the melted state, respectively, on the recording material in the case where the toner amount is large, and (e) is a graph showing a change in glossiness with the toner amount.

Figure 9:
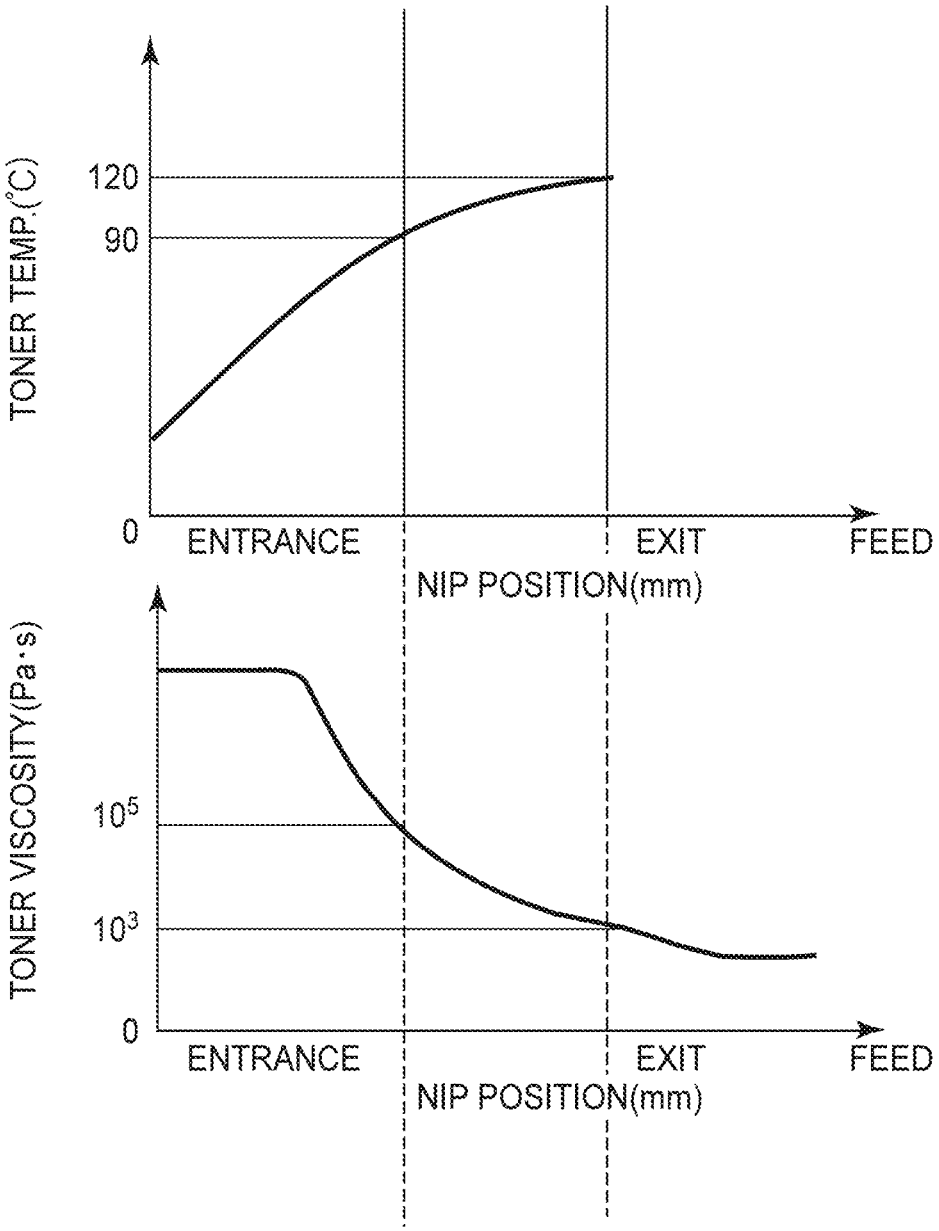

FIG. 9 includes two graphs schematically showing a toner temperature and a melt viscosity, respectively, at a position in a fixing nip with respect to a recording material conveyance direction.

Figure 10:
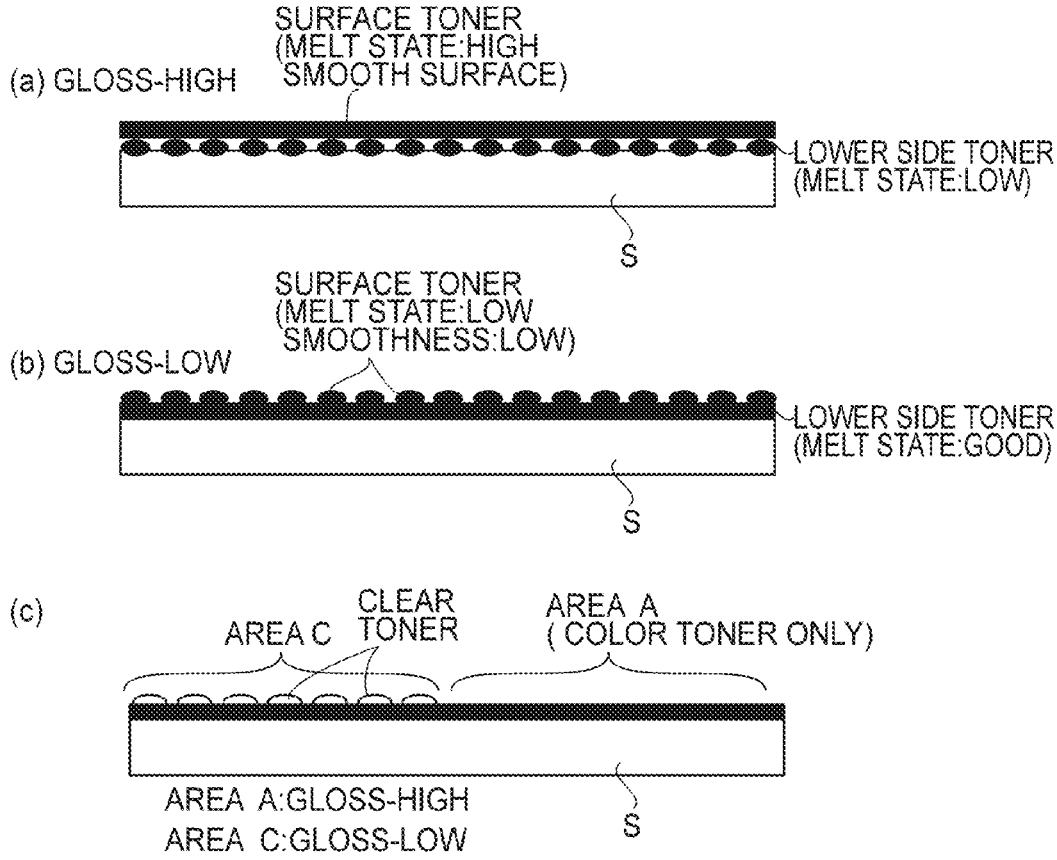

Part (a) of FIG. 10 is a schematic view showing a toner melted state in which glossiness is increased, (b) is a schematic view showing the toner melted state in which the glossiness is decreased, and (c) is a schematic view showing the toner melted state in the case where clear toner is placed on color toner and the case where the clear toner is not placed on the color toner.

Figure 11:
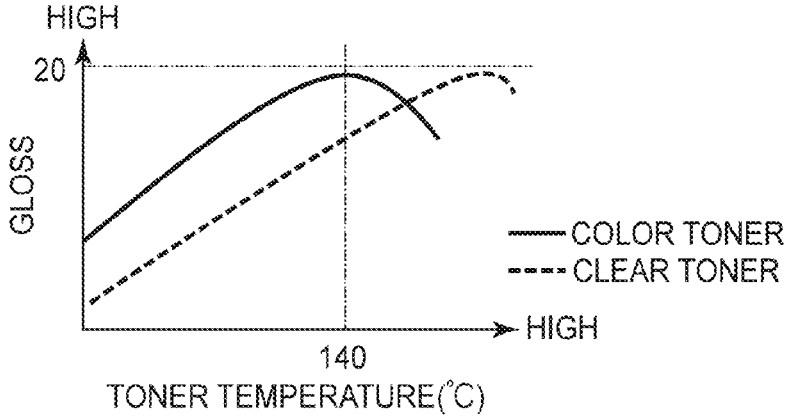

FIG. 11 is a graph showing a glossiness-temperature characteristic of the color toner and the clear toner used in Embodiment 1.

Figure 12:
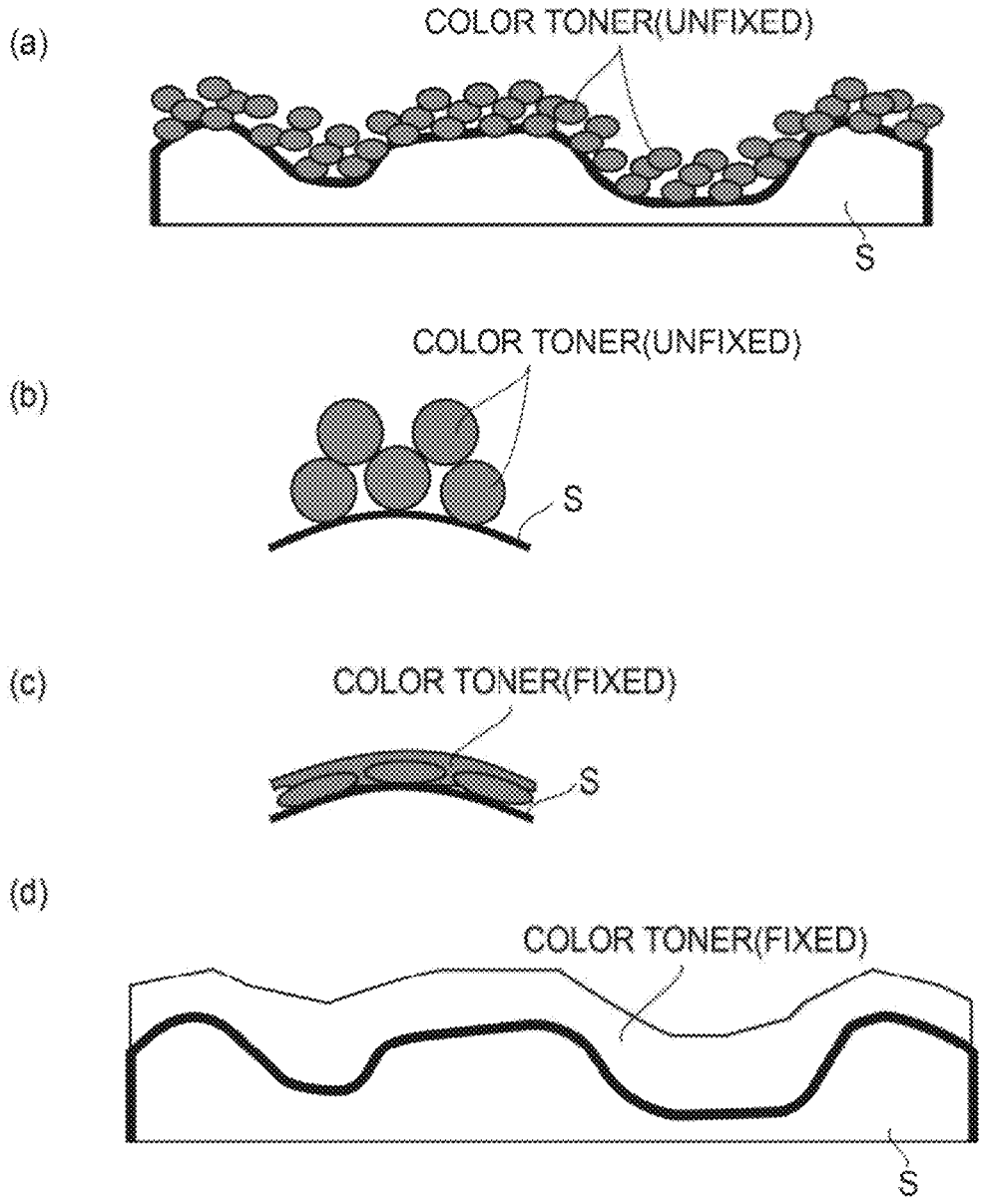

Part (a) of FIG. 12 is a schematic view showing an unfixed state of only the color toner on the recording material, (b) is a partly enlarged view of (a) of FIG. 12, (c) is a partly enlarged view schematically showing a toner melted state of only the color toner on the recording material, and (d) is a schematic view showing the toner melted state of only the color toner on the recording material.

Figure 13:
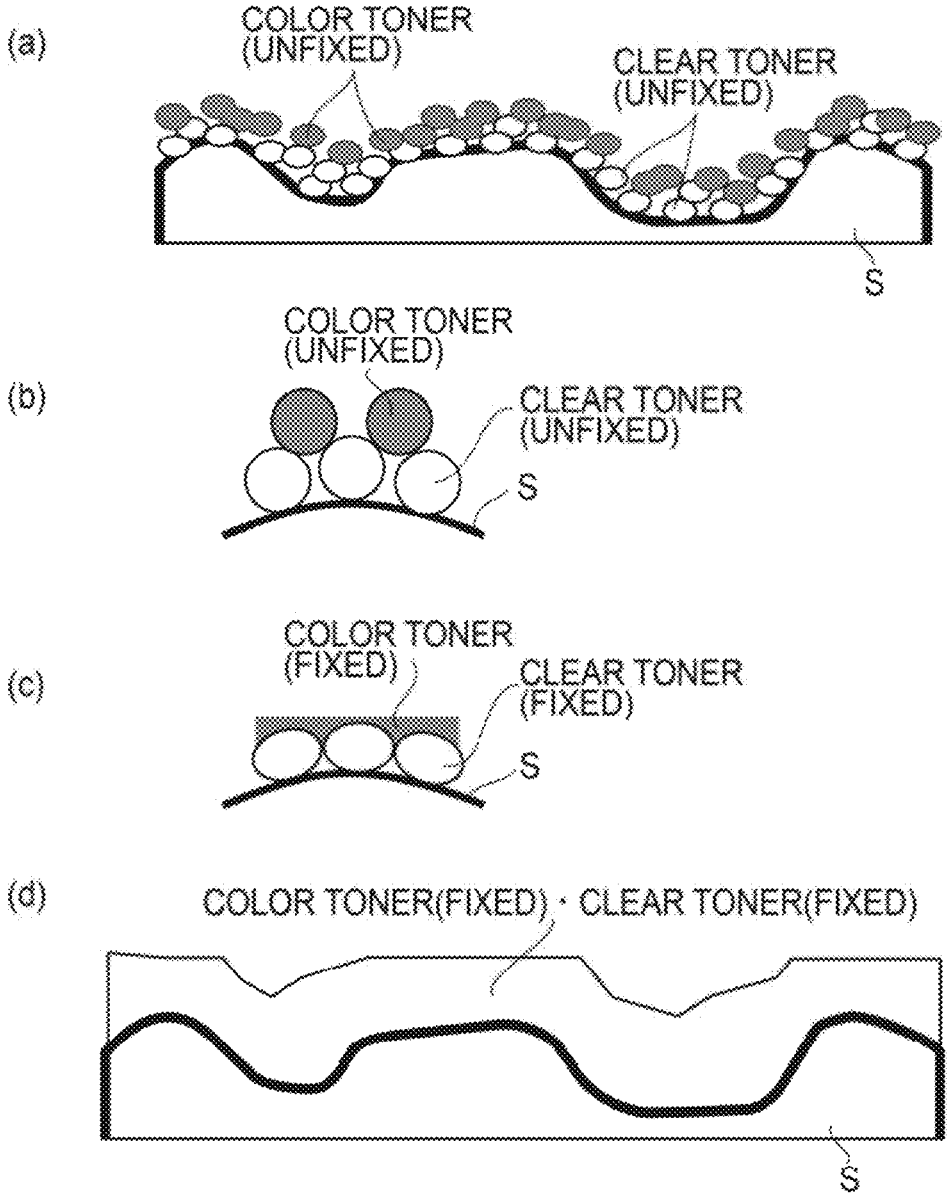

Part (a) of FIG. 13 is a schematic view showing an unfixed state of toner images on the recording material in which the color toner is located on an upper side and the clear toner is located on a lower side, (b) is a partly enlarged view of (a) of FIG. 13, (c) is a partly enlarged view schematically showing the toner melted state of the toner image on the recording material in which the toner image is formed with the color toner on the upper side and with the clear toner on the lower side, and (d) is a partly enlarged view schematically showing the toner melted state of the toner image on the recording material in which the toner image is formed with the color toner on the upper side and with the clear toner on the lower side.

Figure 14:
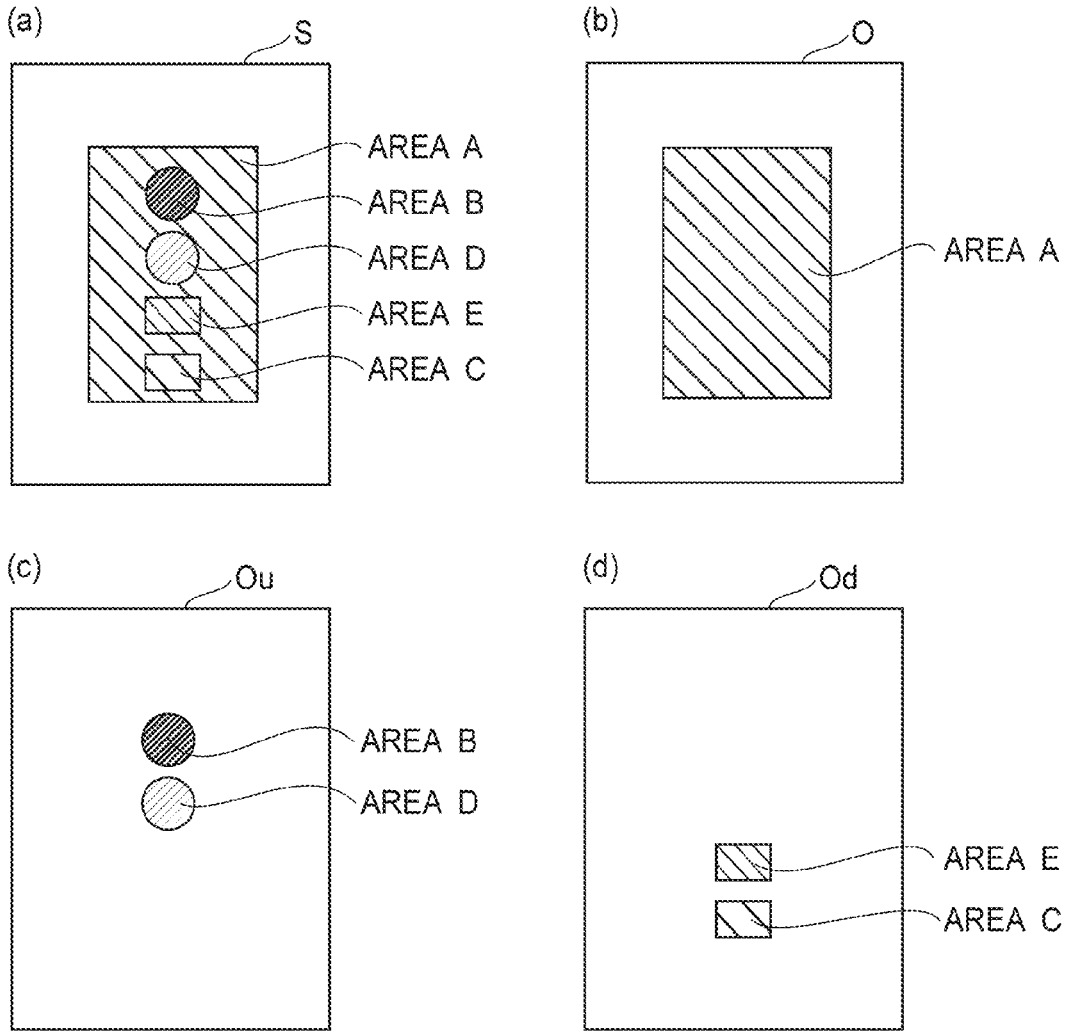

Part (a) of FIG. 14 is a schematic view of an example of an image formed state in a mixed gloss mode in Embodiment 2, (b) is a schematic view of an example of a color original image, (c) is a schematic view of an example of a gloss original image for gloss up, and (d) is a schematic view of an example of a gloss original image for gloss down.

Figure 15:
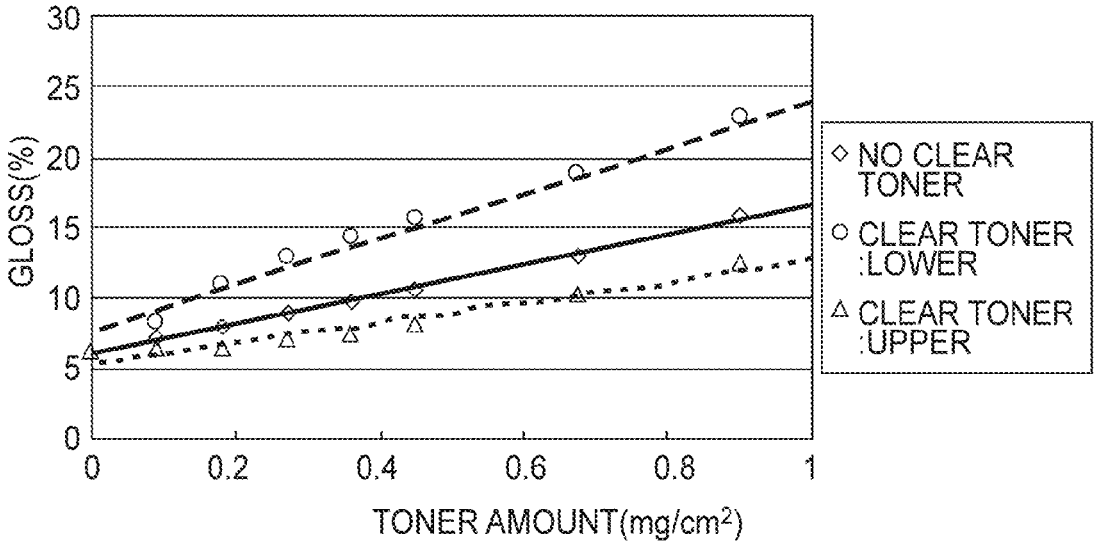
Figure 15:
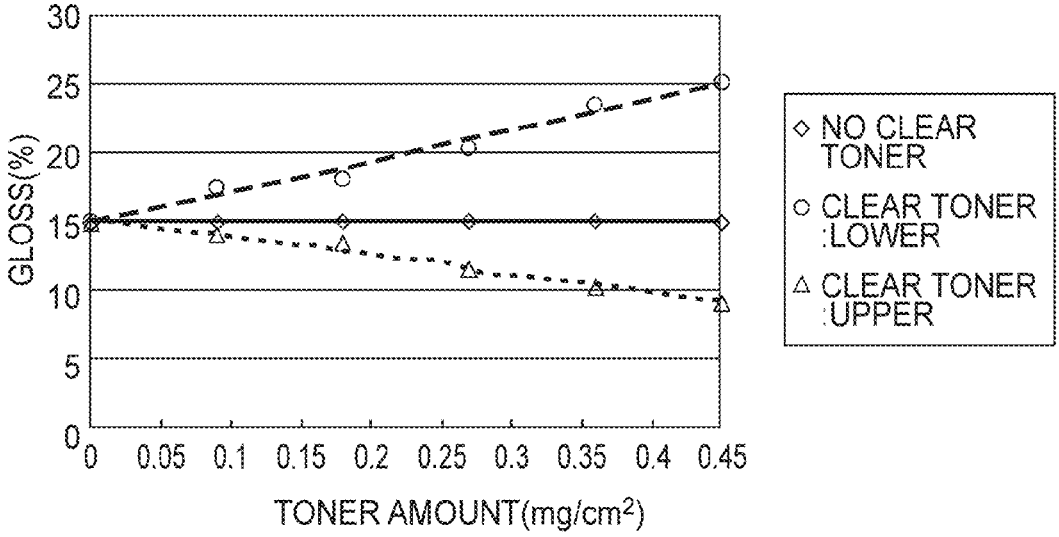

Part (a) of FIG. 15 is a graph showing a change in glossiness in the case where the clear toner (transparent toner) is not placed, in the case where the clear toner is placed on the upper side and in the case where the clear toner is placed on the lower side in Embodiment 1, and (b) is a graph showing a change in glossiness in the case where the clear toner is not placed, in the case where the clear toner is placed on the upper side and in the case where the clear toner is placed on the lower side in Embodiment 2.

DESCRIPTION OF THE PREFERRED EMBODIMENTS

Hereinbelow, the present invention will be described more specifically based on embodiments. Although these embodiments are preferred embodiments in the present invention, the present invention is not limited to these embodiments.

<Embodiment 1>

(1) Image Forming Portion

Figure 1:
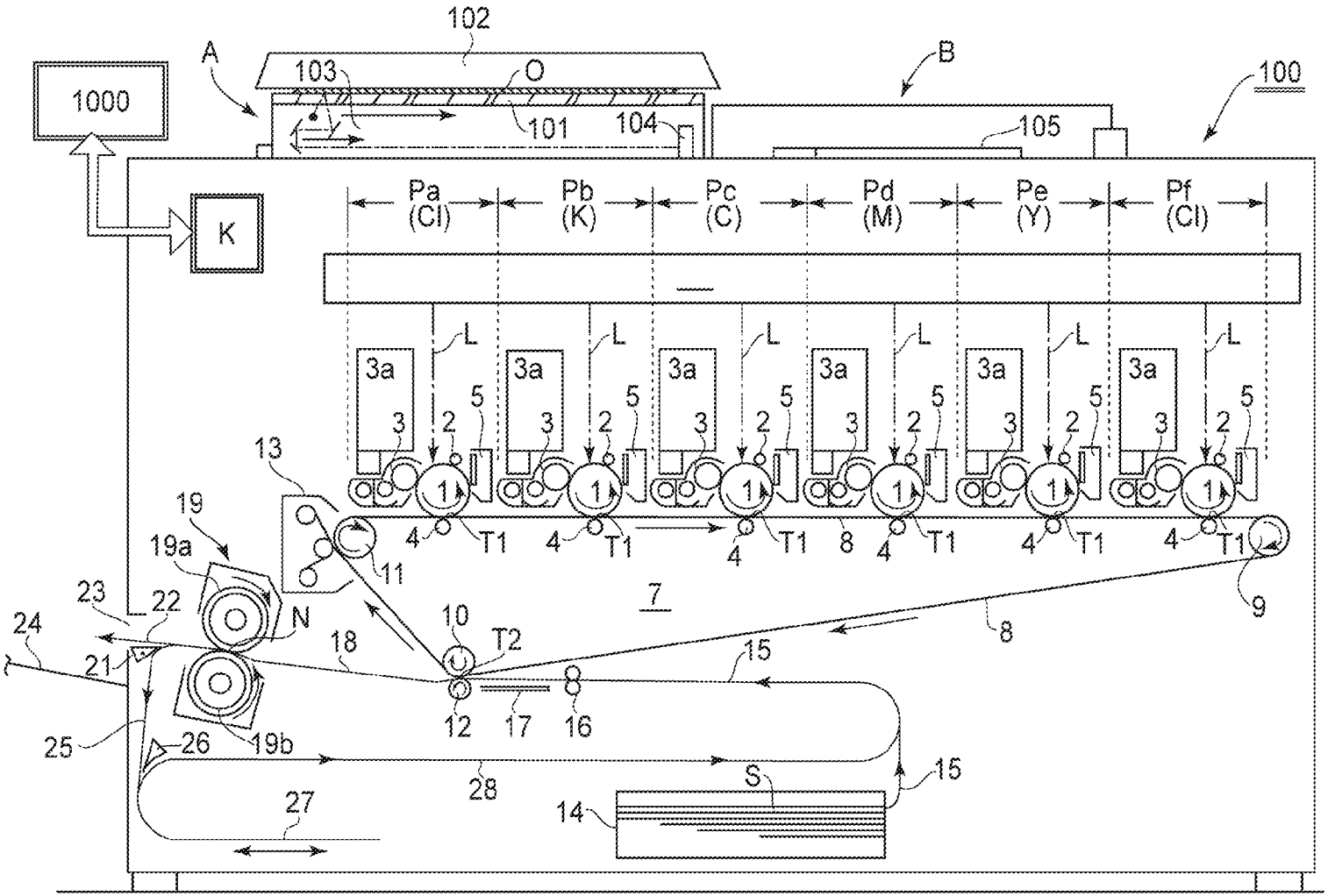
FIG. 1 is a schematic structural view of an image forming apparatus in Embodiment 1.
Figure 2:
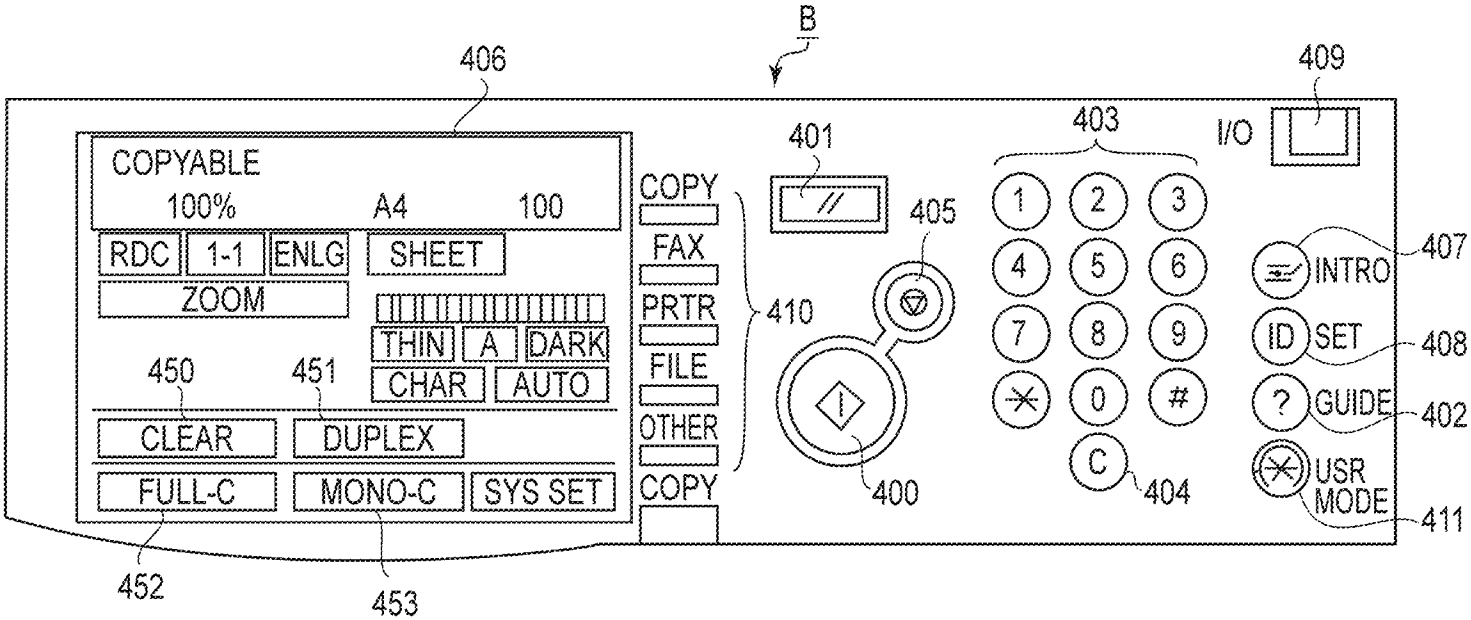
FIG. 2 is a plan view of an operation display portion.

FIG. 1 shows a schematic sectional view of a general structure of a four-color based full color image forming apparatus, as an embodiment of the image forming apparatus of the present invention, of an electrophotographic type, a tandem type and an intermediary transfer type. This apparatus 100 is a multi-function machine, which functions as a copying machine, a printer and a facsimile machine, capable of forming an image which has been subjected to glossing (gloss processing) with clear toner (transparent toner). FIG. 2 is a plan view of an operation display portion B. Part (a) of FIG. 3 is a schematic block diagram of a control system.

A reference symbol K represents a controller (controlling means) which effects centralized control of the apparatus 100. The controller K includes a CPU (computing portion) and a storing portion (ROM, RAM). The reference numeral 1000 represents an external input device (external host device), such as a personal computer or facsimile machine, which is in electrical connection to the controller K through an interface. On an upper surface side of the apparatus 100, an original reading portion (image scanner) A and an operation display portion B are provided. The operation display portion B is operated by a user (operator) to input a command or notifies the user of the condition (state) of the apparatus 100, etc. Inside the apparatus 100, from a left-hand side to a right-hand side in a horizontal direction on the drawing, first to sixth (six) electrophotographic image forming portions Pa, Pb, Pc, Pd, Pe and Pf are successively arranged (tandem arrangement).

The original reading portion A includes an original supporting platen glass 101 and an original confining plate 102 which can be opened and closed relative to the original supporting platen glass 101. In the case of a copy mode (original copying mode), a color original (or monochromatic or black-and-white original) 0 to be copied is placed on the glass 101, following predetermined placement requirements, with an image surface downward. Then, the original O is covered with the plate 102, thus being set. The plate 102 may also be replaced with an automatic original feeding device (ADF, RDF) so that an original in the form of a sheet can be automatically fed onto the glass 101. Then, the user sets desired copying conditions at the operation display portion B and thereafter presses a copy start key 400. As a result, a movable optical system 103 is driven and moved along the bottom surface of the glass 101, so that the downward image surface of the original O on the glass 101 is optically scanned. The original scanning beam is focused on a CCD 104 which is a photoelectric transducer (solid-state image pickup device and is subjected to color-separation reading using three primary colors of R, G, B (red, green, and blue). The respective read signals of RGB are inputted into an image processing portion 105. Then, these signals are processed by the image processing portion 105 into electrical image information for C (cyan image), M (magenta image), Y (yellow image) and K (black image). This electrical image information is inputted into a controller K. The controller K controls a laser scanning mechanism C as an image exposure device so that the laser scanning mechanism C outputs a beam of laser light L, modulated correspondingly to the electrical image information, onto associated one the image forming portions P.

In the case of a printer mode, from the personal computer which is the host device 1000, the electrical image information is inputted into the controller K, so that the apparatus 100 functions as a printer.

In the case of a facsimile receiving mode, from a receiving part of the facsimile machine which is the host device 1000, the electrical image information is inputted into the controller K, so that the apparatus 100 functions as a facsimile receiving machine.

In the case of a facsimile sending mode, the electrical image information of the original has been subjected to photoelectric reading by the original reading portion A is inputted into the controller K from the image processing portion 105 and then is sent to the sending part of the facsimile machine, so that the apparatus 100 functions as a facsimile sending device.

The respective image forming portions P are electrophotographic image forming mechanisms having the same constitution except that the colors of develops (hereinafter referred to as toners) accommodated in associated develop devices 3 are different from each other. Each of the image forming portions P includes a rotatable drum-type electrophotographic photosensitive member (first image bearing member: hereinafter referred to as a drum) 1 on which an electrostatic latent image is to be formed. Each drum 1 is rotationally driven in the counterclockwise direction indicated by an arrow at a predetermined speed. Further, each image forming portion P includes, as process means acting on the drum 1, a charger 2, a developing device 3, a primary transfer charger 4 and a drum cleaner 5. The charger 2 is a charging means for electrically charging the surface of the drum 1 to a predetermined polarity and a predetermined potential uniformly. The developing device 3 is a developing means for visualizing the electrostatic latent image, formed on the surface of the drum 1, as a toner image, and in the developing device 3, a predetermined amount of the toner is fed from a feeding device 3*a*. In the apparatus 100 of this embodiment, clear (Cl) toner is contained in the developing device 3 of the first image forming portion Pa. In the developing device 3 of the second image forming portion Pb, a color toner of black (K) is contained. In the developing device 3 of the third image forming portion Pc, a color toner of cyan (C) is contained. In the developing device 3 of the fourth image forming portion Pd, a color toner of magenta (M) is contained. In the developing device 3 of the fifth image forming portion Pe, a color toner of yellow (Y) is contained. In the developing device 3 of the sixth image forming portion Pf, the clear (Cl) toner identical to that contained in the developing device 3 of the first image forming portion Pa is contained. The cleaner 5 is a cleaning means for removing primary transfer residual toner on the surface of the drum 1.

In this embodiment, the second to fifth image forming portions Pb, Pc, Pd and Pe are a plurality of color toner image forming means each capable of forming a toner image with associated color toner on a recording material. Further, each of the first and sixth image forming portions Pa and Pf is a clear toner image forming means capable of forming a toner image with the clear toner on the recording material. As described above, the clear toner contained in the first image forming portion Pa and the clear toner contained in the sixth image forming portion Pf are identical to each other. That is, as the clear toner, one species of the clear toner (processing a single property) is used.

The laser scanning mechanism C includes a semiconductor laser as a light source device, a polygon mirror, fθ lens and the like and subjects the charged surface of the drum 1 of each image forming portion to scanning exposure with the laser light L modulated correspondingly to the image information of the associated color. That is, the mechanism C scans the drum surface with the laser light L emitted from the semiconductor laser by rotating the polygon mirror and deflects the beam (flux) of the scanning light by a reflection mirror and then focuses the beam on a generatrix line of the drum 1 by the PI lens, thus effecting light exposure. As a result, on the surface of each drum 1, the electrostatic latent image corresponding to the exposed image information is formed.

Below the respective image forming portions P, an intermediary transfer belt unit 7 is disposed. The unit 7 includes a flexible endless belt (second image bearing member: hereinafter referred to as a belt) 8 as an intermediary transfer member. Further, the unit 7 includes a driving roller 9, a secondary transfer opposite roller 10 and a tension roller 11 around which the belt 8 is extended and stretched. The belt 8 is rotationally driven in the clockwise direction indicated by arrows at the same peripheral speed as that of the drum 1 by the roller 9. The primary transfer charger 4 of each image forming portion P is a transfer roller (electroconductive charging roller) in this embodiment and is disposed inside the belt 8. Each transfer roller 4 press-contacts the portion of the belt 8, between the roller 9 and the roller 11, toward the lower surface of the associated drum 1. A contact portion (nip) between each drum 1 and the belt 8 is a primary transfer portion T1. Toward the roller 10, a secondary transfer roller 12 press-contacts the belt 8. The roller 12 is an electroconductive charging roller. A contact portion (nip) between the belt 8 and the roller 12 is a secondary transfer portion T2. At a portion where the belt 8 is partly wound about the roller 11, a cleaner 13 is disposed. In this embodiment, the cleaner 13 uses a cleaning web (nonwoven fabric) as a cleaning member and causes the cleaning member to press-contact the surface of the belt 12 to wipe and remove foreign matter such as secondary transfer residual toner or paper dust on the belt surface.

Below the unit 7, a sheet feeding cassette 14 in which sheets of the recording material (recording medium) S are stacked and accommodated is disposed. Further, a fixing device 19 is disposed on a downstream side of the secondary transfer portion T2 with respect to a recording material conveyance direction.

An operation for forming the full-color image is as follows. The drum 1 of each image forming portion P is rotationally driven in the counterclockwise direction indicated by the arrow at a predetermined control speed. The belt 8 is also rotationally driven in the clockwise direction indicated by the arrows (codirectionally with the drum rotation) at the speed corresponding to the speed of the drum 1. The laser scanning mechanism C is also driven. In synchronism with these drives, at each of the image forming portions P, the charger 2 uniformly charges the surface of the drum 1 to the predetermined polarity and the predetermined potential with predetermined control timing. The mechanism C subjects the surface of the drum 1 to the scanning exposure with the laser light L depending on the image information of the associated color. As a result, the electrostatic latent image depending on the image information of the associated color is formed on the surface of each drum 1 with predetermined control timing Then, the electrostatic latent image is developed as the toner image by the developing device 3. By the electrophotographic image forming process operation as described above, on the drum 1 of the first image forming portion Pa, the Cl (clear) toner image corresponding to a preliminarily designated area pattern is formed. The Cl toner image is primary-transferred onto the belt 8 at the transfer portion T1. On the drum 1 of the second image forming portion Pb, the K (black) toner image corresponding to a K pattern for the full-color image is formed. The K toner image is superposedly primary-transferred onto the Cl toner image, which has already been transferred on the belt 8, at the transfer portion T1. On the drum 1 of the third image forming portion Pc, the C (cyan) toner image corresponding to a C pattern for the full-color image is formed and then is, at the transfer portion T1, superposedly primary-transferred onto the toner images of Cl and K which have already been transferred on the belt 8. On the drum 1 of the fourth image forming portion Pd, the M (magenta) toner image corresponding to an M pattern for the full-color image is formed. The M toner image is, at the transfer portion T1, superposedly primary-transferred onto the toner images of Cl, K and C which have already been formed on the belt 8. On the drum 1 of the fifth image forming portion Pe, the Y (yellow) toner image corresponding to a Y pattern for the full-color image is formed. The Y image is, at the transfer portion T1, superposedly primary-transferred onto the toner images of Cl, K, C and M which have already been transferred on the belt 8. On the drum 1 of the sixth image forming portion Pf, the Cl (clear) toner image corresponding to the preliminarily designated area pattern is formed. The Cl toner image is, at the transfer portion T1, superposedly primary-transferred onto the toner images of Cl, K, C, M and Y which have already been formed on the belt 8.

At each image forming portion P, the primary transfer of the toner image from the drum 1 onto the belt 8 is performed by an electric field generated by applying a charging bias of a predetermined potential and an opposite polarity to a normal charge polarity of the toner from a power source portion (unshown) to the roller 5 and (performed) by nip pressure. Thus, on the belt 8, unfixed toner images which are four-color (K, C, M, Y) based full-color toner images including the clear toner image are synthetically formed on the belt 8 in the order of the toner images of Cl, K, C, M, Y, Cl from the belt side. At each image forming portion P, the toner remaining on the surface of the drum 1 after the primary transfer of the toner image onto the belt 8 is removed by the cleaner 5.

Here, with respect to the formation of the clear toner image at the first and sixth image forming portions Pa and Pf, there are the case where the image formation is effected at the first image forming portion Pa or the sixth image forming portion Pf and the case where the image formation is effected at both of the first and sixth image forming portions Pa and Pf. This will be described later.

On the other hand, with predetermined control timing, a sheet feeding roller (unshown) for the sheet feeding cassette 14 is driven. As a result, one of the sheets of the recording material S stacked on the cassette 14 is separated and fed. The fed recording material S passes through a conveying path 15 to reach a registration roller pair 16. The roller pair 16 starts and stops its rotation by a motor (unshown) controlled by the controller K. The roller pair 16 once receives a leading end portion of the recording material S conveyed along the conveying path 15 and corrects oblique movement of the recording material S and then feeds the recording material S with predetermined control timing. The fed recording material S is introduced into the secondary transfer portion T2 by a pre-transfer guide 17. Then, the recording material S is subjected to successive transfer (secondary transfer) of the unfixed toner images from the belt 8 during a process in which the recording material S is nip-conveyed in the secondary transfer portion T2. The secondary transfer is performed by nip pressure in the transfer portion T2 and an electric field generated by applying a charging bias of a predetermined potential and an opposite polarity to the normal charge polarity of the toner from a power source portion (unshown) to the roller 12. The belt surface after the toner image transfer onto the recording material S reaches the cleaner 13 by further rotation of the belt 8 and is cleaned by being subjected to removal of foreign matter such as secondary transfer residual toner or paper dust, thus being subjected to the image formation repetitively. The secondary transfer bias during the toner image transfer onto the recording material S has the opposite polarity to the toner charge polarity and is controlled by the controller K so as to be set optimally depending on an environment (ambient temperature and humidity of the apparatus) and the type (basis weight, surface property) of the recording material S.

The recording material S which has passed through the transfer portion T2 is successively separated from the surface of the belt 8 and passes through a conveying path 18 to be introduced into the fixing device (fixing portion) 19. The fixing device 19 is a fixing means for heat-fixing the toner images formed on the recording material S. The recording material S is nip-conveyed in a fixing nip N of the fixing device 19 to be heated and presses, so that the unfixed toner images are heat-fixed on the recording material as a fixed image. The fixing device 19 in this embodiment is of a heat roller type and includes, as a fixing member, a rotatable fixing roller 19*a* and a rotatable pressing roller 19*b* which are caused to press-contact each other to form the fixing nip N. More specifically, each of the rollers 19*a* and 19*b* is a composite material roller of 60 mm in outer diameter prepared by molding an elastic layer on an outer peripheral surface of a hollow core metal and then by coating the surface of the elastic layer with a surface parting layer. The hollow core metal is formed of Fe and is 54.6 mm in inner diameter, 56.0 mm in outer diameter and 0.7 mm in thickness. The elastic layer is a silicone rubber layer of 2 mm in thickness. The surface parting layer is a coating layer of PFA tube of 30 μm in thickness. Inside each of the rollers 19*a* and 19*b*, a roller heating heater is provided. Further, a thermistor for detecting a temperature is provided on the surface of each of the rollers 19*a* and 19*b*. A total pressure applied between the rollers 19*a* and 19*b* was 80 kgf (784 N). The roller 19*a* is rotationally driven in the clockwise direction indicated by an arrow at a predetermined speed by a driving source. The roller 19*b* is rotated by the rotation of the roller 19*a*. Each of the rollers 19*a* and 19*b* is heated by supplying electric power from an electric power supplying portion to the associated heater. The temperature of each of the rollers 19*a* and 19*b* is detected by the corresponding (associated) thermistor, and each detected temperature information is inputted into the controller K. The controller K controls the electric power supply from the electric power supplying portion to each heater so that the temperature of each of the rollers 19*a* and 19*b* is increased to a predetermined temperature and is kept at the predetermined temperature on the basis of the associated inputted detected temperature information. In the above state, the recording material S on which the unfixed toner images are formed is introduced from the image forming portion side into the nip N and is nip-conveyed in the nip N. In the nip-conveying process, the unfixed toner images are fixed as the fixed image by the heat of the fixing roller 19*a* and the nip pressure.

The recording material S coming out of the fixing device 19 is, in the case of a one-side image forming mode, introduced into a discharge conveying path 22 side by a first flapper 21 controlled in a first attitude and then is discharged and placed on a discharging tray 24 through a discharge opening 23 as a one-side full-color image formation product. In a both-side image forming mode, the recording material S, which has been subjected to the image formation on a first surface side, coming out of the fixing device 19 is guided to a reverse conveying path 25 side by the first flapper 21 controlled in a second attitude and then is introduced into a switch back conveying path 27 by a second flapper 26 controlled in a first attitude. Then, the recording material S is subjected to switch-back conveyance and then is introduced into a both-side conveying path 28 by the second flapper 26 controlled in a second attitude. Further, the recording material S is introduced from the both-side conveying path 28 into the conveying path 15 again and passes through the registration roller pair 16 and the pre-transfer guide 17 to be introduced into the secondary transfer portion T2 in a upside (first surface side)-down state. As a result, the toner images are transferred onto a second surface of the recording material S at the transfer portion T2. Thereafter, similarly as in the image forming operation on the first surface, the recording material S passes through the conveying path 18, the fixing device 19, a discharging conveying path 22 and the discharge opening 23 and is discharged and placed on the discharging tray 24 as a both-side image formation product. Further, in the case of a mono-color image forming mode such as a monochromatic image forming mode, only the image forming portion for forming an associated image performs the image forming operation, so that a one-side or both-side mono-color image formation product is discharged and placed on the discharging tray 24.

In the case where the image forming mode is a non-clear mode (non-glossing mode) using no clear toner, in the above-described image forming operation, the image formation at the first and sixth image forming portions Pa and Pf are not effected. Further, the image formation at other image forming portions for the color toner images is effected, so that it is possible to output the image formation product of the non-clear full-color or non-clear mono-color toner image by the operation similar to that described above.

(2) Operation Display Portion B

At the operation display portion B shown in FIG. 2, a reference numeral 400 is a copy start key for instructing copying. A reference numeral 401 is a reset key for resetting the image forming mode to a normal mode. In the normal mode, "monochromatic single-side, and non-clear" is set for the image formation. A reference numeral 402 is a guidance key, which is to be pressed when a guidance function is used. A reference numeral 403 is a group of numerical keys to be used to input a numerical value, such as a pre-set number of copies to be made. A reference numeral 404 is a clear key for clearing the inputted numerical value. A reference numeral 405 is a stop key for interrupting a copying operation during continuous copying. A reference numeral 406 is a liquid crystal display portion and a touch panel which display various mode settings, printer conditions, etc. A reference numeral 407 is an interruption key for interrupting the operation during the continuous copying or during the use of the apparatus as the facsimile machine or the printer to make urgent copying. A reference numeral 408 is a pass word key for controlling the copy count for each user or each section. A reference numeral 409 is a soft switch for turning on or off the electrical power source of a main assembly of the image forming apparatus. A reference numeral 410 is a function (selection) key for switching the function of the image forming apparatus. A reference numeral 411 is a user mode key for placing the image forming apparatus into a user mode to enable a user to preset options, such as turning on or off of an automatic cassette change, or a change in set time until the image forming apparatus is placed in an energy saving mode. A reference numeral 450 is a selection key of a glossing mode (gloss-up mode/gloss-down mode/mixed gloss mode). A reference numeral 451 is the both-side image formation mode selection key. A reference numeral 452 is the full-color image formation mode selection key. A reference numeral 453 is the mono-color image formation mode selection key.

(3) Toner

The toners used in this embodiment will be described. As the toners, those using polyester-based resin were used. The toners may be manufactured by pulverization but as the toner manufacturing method, a method (polymerization method), for directly manufacturing the toners in a machine, such as suspension polymerization, interfacial polymerization, dispersion polymerization, or the like may preferably be used. The ingredients and the manufacturing method of the toners are not limited thereto. As the color toners of C, M, Y and K, it is possible to use toners constituted by thermoplastic resin materials which contain colorants for the respective colors. In this embodiment, color toners using, as a binder (resin), a polyester resin material having a melt viscosity characteristic such as a temperature-melt viscosity property of the toner as shown in (b) of FIG. 3 were used. As the clear toner, a transparent thermoplastic resin material which has a higher viscosity than that of the color toners and contains no colorant was used.

In this embodiment, as the color toner and the clear toner, those possessing the melt viscosity characteristics as shown in (b) of FIG. 3 were used. In an operating temperature range, the melt viscosity characteristic is not limited to that shown in (b) of FIG. 3, when a melt viscosity η (Pa·s) at a temperature T (° C.) satisfies the following relationships:

$$\eta color(T) < \eta clear(T),$$

wherein ηcolor (T) is the melt viscosity of the color toner at T ° C., and ηclear (T) is the melt viscosity of the clear toner at T ° C.

(4) Amount of Image Data

The amount of image data used in the description of the present invention means the amount of data, per (one) pixel, of the image information of the image as the original which is separated into respective color component images of C, M, Y and K. The maximum amount of image data for each color will be expressed as 100%. The amount of each toner to be subjected to the image formation is calculated based on the amount of image data in the range of 0-100%.

The toner amount means the amount of toner per unit (one) pixel subjected to the image formation on the recording material. The toner amount also is expressed in the range of 0-100% similarly as the amount of image data. The weight of the toner per 1 $cm^2$ subjected to the image formation on the recording material is referred to as the toner amount per unit area. When the toner amount of single-color toner is 100%, the single-color toner has a maximum (image) density.

The process conditions of the main assembly, such as development conditions, are determined so that the image density (0-100%) becomes linear, corresponding to the toner amount (0-100%) on the basis of the maximum density. The maximum density is affected by the toner properties, fixation conditions of the fixing device 19, the type of recording material S, and the like. Further, the maximum density also varies depending on image design such that the maximum density for each color is set at what level of the density.

In this embodiment, the process speed was 200 mm/sec. A control temperature (target temperature) of the fixing device 19 was 180 ° C. In this case, the image density of 1.5 was obtained for all the colors at the color toner amount per unit area of 0.4 mg/cm$^2$ by using plain paper (paper glossiness of about 6%), which is 80 g/m$^2$ in basis weight. This toner amount per unit area of 0.4 mg/cm$^2$ was used as the maximum amount per unit area for each (one) color. Further, the glossiness at that time was about 15%. In a glossiness measuring method, handy-type gloss meter ("PG-IM", mfd. by Nippon Denshoku Industries Co., Ltd.) (based on JIS Z 8741 "mirror surface glossiness measuring method") was used.

Based on this data, an image correction such as gamma correction is made so that a color tone (hue) coincides with the amount of image data of the image to be outputted for each color and then the toner amount for each pixel is calculated to effect the image formation. Then, the respective color toner images are superposed to represent various colors. At this time, in theory, as the color image information, the amount of image data is 400% at the maximum. Further, the clear toner image information of 100% is also added. With respect to the clear toner image, the toner amount per unit area, not the density is set so as to provide a desired glossiness. With respect to the glossiness of the clear toner, when the image formation was effected on the plain paper (paper glossiness of about 6%) having the basis weight of 80 g/m$^2$ by using the clear toner, the glossiness of about 10% was obtained in 60-degrees glossiness measurement in the toner amount per unit area of 0.4 mg/cm$^2$.

Further, with respect to coated paper, the process speed was 100 mm/sec, and the control temperature of the fixing device 19 was 160° C. At this time, by using gloss coated paper (paper glossiness of 30%) of 128 g/m$^2$ in basis weight, the image density of 1.9 was obtained for each of all the colors in the toner amount per unit area of 0.4 mg/cm$^2$. Further, at that time, the glossiness was about 40%.

With respect to the glossiness of the clear toner, when the image formation using the clear toner was effected on the gloss coated paper (paper glossiness of 30%) of 128 g/m$^2$ in basis weight, the glossiness of 20% was obtained in the 60-degree measurement in the toner amount per unit area of 0.4 mg/cm$^2$.

The maximum amount per unit area of the clear toner does not need to be equal to the maximum amount per unit area of the color toner. The toner amount per unit area capable of providing desired glossiness may be used as the maximum toner amount per unit area.

As described above, in theory, as the color image information, the amount of the image data is 400% at the maximum. However, in actual image formation, the toner in the amount corresponding to 400% is not used. It is preferable that methods such as UCR, GCR, etc., which will be described below are used so that the maximum amount of image data for the color image is set so as to fall in a range of 180%-240%.

UCR stands for "Under Color Removal". When the color original is color-separated into four color components, a gray components generates at a portion where the three color components of C, M and Y overlap each other. In the VCR, the gray component is replaced with a solid black (Bk) component, and the object of the UCR is to reduce the total amount of image data by replacing the above described gray component, having the density not less than a certain level, with the black component.

GCR stands for "Gray Component Replacement". A point having the same ratio among C, M and Y appears black or gray. By replacing this point with K (black) point, it is possible to reduce the image in dot ratio, so that the total dot area ratio is decreased.

In this embodiment, the above-described methods are used so that the maximum total toner amount in an area in which the image is formed with only the color toner was 200% and so that the maximum total toner amount which is the sum of the color toner amount and the clear toner amount was 240%. Then, the design of the fixing device was made so as to fix the toners in the amount of 240% at one time.

(5) Grossing

FIG. 4 is a control flow chart during selection of the glossing mode (gloss mode or clear mode). In the glossing mode, an image formation product formed by superposing the color toner images and the clear toner image on the same recording material is outputted. An execution body of the flow chart of FIG. 4 is a CPU of the controller K as a control means. The CPU controls respective portions on the basis of a program stored in ROM. The CPU functions as an order (sequence) determining means.

The selection of the glossing mode is made by selecting the gloss mode selection key 450 at the liquid crystal display portion and touch panel 406, of the operation display portion B, at which settings of various modes and printer conditions are displayed. By the selection, as shown in FIG. 5(*a*), mode keys for gloss-up correction, gloss-down correction and mixed gloss correction are displayed on the panel 406. The gloss-up correction mode key is used in the case where the user intends to increase the gloss in a selected area so as to be higher than that in other areas. The gloss-down correction mode key is used in the case where the user intends to decrease the gloss in the selected area so as to be lower than that in other areas. The mixed gloss correction mode keys used in the case where an image including both of an area in which the gloss is made made higher than that in other areas and an area in which the gloss is made lower than that in other areas with respect to the area designated by the user is outputted is used. In the glossing output mode, in addition to the color toner image formation by the second to fifth image forming portions Pd, Pc, Pd and Pe, the clear toner image formation by the first or/and sixth image forming portions Pa and Pf is effected.

1) In the copy mode, the clear image of the original O cannot be read by the original reading portion (image scanner) A. However, in advance, the image at a portion intended to be outputted so that the gloss at the portion is made higher or lower than that at adjacent color toner image portions has been outputted as a white/black (monochromatic) image. The image may be scanned by the original reading portion A after a mode for reading the monochromatic image portion of the original so as to be recognized as a gloss designation image is set by the operation display portion B. Incidentally, herein, the gloss designation image is classified into an image discriminated or designated as an object such as a character or color information, an image discriminated or designated as a certain area, and the like, and is appropriately determined.

In the copy mode, when the glossing mode selection key 450 is selected, on the panel 406, the mode keys for the gloss-up correction, the gloss-down correction and the mixed gloss correction as shown in (a) of FIG. 5 are displayed. After the up key, the down key or the mixed key is selected, the original O ((a) of FIG. 6) for reading the color information of C, M, Y and K is read by the original reading portion A (step S 101 of FIG. 4). Further, in order to perform the glossing, e.g., one or both of a gloss-up designation image (original) Ou ((b) of FIG. 6) and a gloss-down designation image (original) Od ((c) of FIG. 6) which have been prepared as a white/black (monochromatic) image in advance are successively read by the original reading portion A (step S101).

For example, when the gloss-up correction button (key) or the gloss-down correction button (key) is selected on the selection screen of (a) of FIG. 5, as shown in (b) of FIG. 5, a screen for designating that the color original (color information) is read (by the original reading portion A) is displayed. Then, the original O shown in (a) of FIG. 6 is placed on the original reading portion A and the OK button on the screen shown in (b) of FIG. 5 is pressed, so that the reading of the image information of the original O is executed and completed (step S101). Then, as shown in (c) of FIG. 5, on the panel 406, a screen for designating that the gloss original (gloss information) is read is displayed. Then, the gloss-up designation image original Ou shown in (b) of FIG. 6 or the gloss-down designation image original Od shown in (c) of FIG. 6 is placed. Then, the reading of the gloss original Ou or Od is executed by pressing the OK button on the screen shown in (c) of FIG. 5 and is then completed (step S101).

By performing the operation as described above, the controller K obtains the image information of each of the colors of C, M, Y and K and the gloss information of clear. Then, as shown in (d) of FIG. 6, it becomes possible to output an output product Su including an image partly increased in gloss (steps S102, S105, S107 and S108). Alternatively, as shown in (e) of FIG. 6, it becomes possible output an output product Sd including an image partly decreased in gloss (steps S102, S106, S107 and S108). Here, (d) of FIG. 6 is an illustration of the image for designating the portion at which the gloss is increased relatively. A portion "ABC" is the area in which the gloss is increased. Similarly, (e) of FIG. 6 is an illustration of the image for designating the portion at which the gloss is decreased relatively. A portion "DEF" is the area in which the gloss is decreased. Further, (f) of FIG. 6 is an illustration of the image to be finally formed on the recording material (sheet).

On the other hand, when the mixed gloss correction button (key) is selected on the selection screen of (a) of FIG. 5, as shown in (d) of FIG. 5, a screen for designating that the color original is read (by the original reading portion A) is displayed on the panel 406. Then, the original O shown in (a) of FIG. 6 is placed on the original reading portion A and the OK button on the screen shown in (d) of FIG. 5 is pressed, so that the reading of the color original is executed and completed (step S101). Then, as shown in (e) of FIG. 5, on the panel 406, a screen for designating that the gloss original (gloss information) for gloss up is read is displayed. Then, the gloss-up designation image original Ou shown in (b) of FIG. 6 is placed and then, the reading of the gloss original for gloss-up is executed by pressing the OK button on the screen shown in (e) of FIG. 5 and is then completed (step S 101). Then, as shown in (f) of FIG. 5, on the panel 406, a screen for designating that the gloss original for gloss down is read is displayed. Then, the gloss-down designation image original Od shown in (c) of FIG. 6 is placed and then, the reading of the gloss original for gloss down is executed by pressing the OK button on the screen shown in (f) of FIG. 5 and is then completed (step S101).

By performing the operation as described above, the controller (portion) K obtains the image information of each of the colors of C, M, Y and K and the gloss information of clear. Then, as shown in (f) of FIG. 6, it becomes possible to output a print Su-d including an image which includes an area in which the gloss is partly increased an area in which the gloss is partly decreased are co-present (steps S102, S103, S104, S107 and S108).

In the above, the panel 406 of the operation display portion B which is the operating portion, and the original reading portion A constitute a glossiness area designating means capable of allowing the user to designate the area in which the glossiness of the image to be outputted is partly increased, or partly decreased, or partly increased and partly decreased. Incidentally, the information on the area, in which the glossiness is increased, or decreased, or increased and decreased, designated by the glossiness area designating means is obtained by the controller K as the (information) obtaining means. The controller K controls the image forming apparatus on the basis of the obtained information. Incidentally, the glossiness area designating means may also be not provided in the main assembly of the image forming apparatus. Specifically, the glossiness area may also be designated by the external host device 1000 such as the PC or the like, through a network.

2) Further, in the printer mode, the image (data) intended to be outputted is prepared by the personal computer (PC) which is the external host device 1000 by using an image software capable of processing the clear image or the gloss information. Then, on the basis of the prepared image data, at an RIP (raster image processor) portion, the prepared image data is converted into image information of each of the colors of C, M, Y, K and clear. At this time, whether the gloss of the prepared gloss designating area image is increased or decreased can be designated by the software. The image data converted into the image information of each color is converted into image information corresponding to that for output equipment by a printer driver and is sent as an electric signal to the main assembly of the image forming apparatus. Thus, as shown in (d), (e) and (f) of FIG. 6, it becomes possible to output the output products Su, Sd and Su-d including the images partly different in glossiness.

In the above, the external host device 1000 is the glossiness area designating means capable of allowing the user to designate the area in which the glossiness of the image to be outputted is partly increased, or partly decreased, or partly increased and partly decreased. Incidentally, to the main assembly of the image forming apparatus, the information on the area designated by the external host device 1000 is transmitted through the network. Then, the transmitted information is obtained by the controller K as the obtaining means.

(6) Image Formation and Fixing Step During Glossing Mode Selection

The image formation and the fixing step by using the color toners and the clear toner in the case where the glossing mode is selected will be described. In this embodiment, the case where the glossing mode selection key 450 is selected on the panel 406 of the operation display portion B in the copy mode will be described in detail but a similar operation is performed also in the case where the glossing signal is sent in the printer mode. Further, in the following, the description will be made by taking an image discriminated and designated as a certain area as the gloss designation image but a similar operation is performed also in the case where an image discriminated and designated as the character information or the object such as the color information.

Here, in the mode in which the glossing is performed, the image formation and fixation are effected by using the color toners and the clear toner. However, in this case, the color image data amount, the clear image data amount and the sum of the color image data amount and the clear image data amount are required. At this time, calculation of the image data amount is made with respect to all the pixels. In this embodiment, the controller K computes the color toner amount, the clear toner amount and the total toner amount which is the sum of the color toner amount and the clear toner amount with respect to the toner image to be formed on the recording material, on the basis of the electrical image information inputted from the image processing portion, the external host device, or the like.

1) The Case where Gloss-Up Correction Key is Selected

When the gloss-up correction key is selected on the panel screen shown in (a) of FIG. 5, the image formation is executed along an "UP MODE (FLOW)" shown in FIG. 4. The clear toner formation (provision) determination means is a clear toner formation determination function portion of the controller K and determines formation of the clear toner on an upper side or a lower side of the color toners. In the "UP MODE", in the area designated so as to increase the gloss, the formation of the clear toner on the lower side of the color toners is determined (step S105 of FIG. 4). On the basis of this determination, the controller K caused the second to sixth image forming portions Pb, Pc, Pd, Pe and Pf to perform the image forming operation. Then, on the recording material S, the clear toner image is formed and the color toner images are formed so as to cover the clear toner image. The recording material S is introduced into the fixing device 19, so that fixation of the color toner images and the clear toner image is effected. Incidentally, in this embodiment, on the intermediary transfer belt, the color toner images are formed and then the clear toner image is formed so as to cover the color toner images. Incidentally, this relationship varies depending on the number of times the intermediary transfer is performed.

In this image forming mode in the area designated so as to increase the gloss, at the sixth image forming portion Pf, the clear toner image is formed in the neighborhood of the recording material, i.e., on the lowermost layer side of the resultant toner images. Further, in this embodiment, the maximum total toner amount in the area in which the image formation is effected with only the color toners is 200%, and the maximum total toner amount which is the sum of the color toner amounts and the clear toner amount is 240%. However, the toner amount is not limited thereto. For example, in the case where the maximum total toner amount in the area in which the image formation is effected with only the color toners is 180%, the image formation may be effected so that the sum of the amounts per unit area of the color toners and the clear toner is 240% or less.

As an example, an image formation state is shown in (a) of FIG. 7. Incidentally, the image formation state described here is merely the example and thus the present invention is not limited thereto. An area A is a 190%-image area formed with only the color toners. A area B is an area, designated so as to partly increase the glossiness, in which a 50%-clear toner layer is formed on the lower side of the 190%-color toner layer and thus the total toner amount (per unit area) is 240%. Here, in the area B which was intended to partly increase the glossiness, the total toner amount was set so as to be more than that in another area and was set at 240% in this case. In the area B, the toner amount is set so that the upper side color toner layer of the toner image surface is 190% in toner amount per unit area and the lower side clear toner layer of the toner image surface is 50% in toner amount per unit area. That is, in the area intended to partly increase the glossiness color toner amount per unit area is X1 (%) and the clear toner amount per unit area is X2 (%), X2 and X2 are set to satisfy: X1 +X2 =240 (trial calculation formula).

When the gloss-up correction key is selected and the reading of necessary color information and gloss information is ended (step S101), the amounts of the color toners and the clear toner are determined on the basis of the trial calculation formula described above (step S 107). Then, the color toner images and the clear toner image are formed at the second to sixth image forming portions Pb, Pc, Pd, Pe and Pf. Then, at the secondary transfer portion T2, onto the recording material S, the color toner images and the toner image including the upper side color toner images and the lower side clear toner image in the designated area are transferred (step S 108). The recording material S is subjected to the fixing step and then is outputted, so that the output product which is partly increased in glossiness (d) of FIG. 6 and (a) of FIG. 7) can be obtained.

2) The Case where Gloss-Down Correction Key is Selected

When the gloss-down correction key is selected on the panel screen shown in (a) of FIG. 5, the image formation is executed along an "DOWN MODE (FLOW)" shown in FIG. 4. In the "DOWN MODE", in the area designated so as to decrease the gloss by the clear toner formation order determination means, the formation of the clear toner on the upper side of the color toners is determined (step S106 of FIG. 4). On the basis of this determination, the controller K caused the first to fifth image forming portions Pa, Pb, Pc, Pd and Pe to perform the image forming operation, so that, on the recording material S, the image formation is effected in a manner such that the clear toner is provided (placed) in the designated area on the color toners. The recording material S is introduced into the fixing device 19, so that fixation of the color toner images and the clear toner image is effected.

In this image forming mode in the area designated so as to decrease the gloss, at the first image forming portion Pa, the clear toner image is formed on the side in the neighborhood of the contact surface with the fixing roller 19*a* of the fixing device 19, i.e., on the uppermost surface layer side of the resultant toner images. Further, in this embodiment, the maximum total toner amount in the area in which the image formation is effected with only the color toners is 200%, and the maximum total toner amount which is the sum of the color toner amounts and the clear toner amount is 240%. However, the toner amount is not limited thereto. For example, in the case where the maximum total toner amount in the area in which the image formation is effected with only the color toners is 180%, the image formation may be effected so that the sum of the amounts per unit area of the color toners and the clear toner is 240% or less.

As an example, an image formation state is shown in (b) of FIG. 7. Incidentally, the image formation state described here is merely the example and thus the present invention is not limited thereto. An area A is a 190%-image area formed with only the color toners. A area C is an area, designated so as to partly decrease the glossiness, in which a 50%-clear toner layer is formed on the upper side of the 190%-color toner layer and thus the total toner amount (per unit area) is 240%. Here, in the area C which was intended to partly increase the glossiness, the total toner amount was set so as to be more than that in another area and was set at 240% in this case. In the area C, the toner amount is set so that the lower side color toner layer of the toner image surface is 190% in toner amount per unit area and the upper side clear toner layer of the toner image surface is 50% in toner amount per unit area. That is, in the area intended to partly increase the glossiness color toner amount per unit area is X1 (%) and the clear toner amount per unit area is X2 (%), X2 and X2 are set to satisfy: X1 +X2 =240 (trial calculation formula).

When the gloss-down correction key is selected and the reading of necessary color information and gloss information is ended (step S101), the amounts of the color toners and the clear toner are determined on the basis of the trial calculation formula described above (step S 107). Then, the clear toner image and the color toner images are formed at the first to fifth image forming portions Pa, Pb, Pc, Pd and Pe. Then, at the secondary transfer portion T2, onto the recording material S, the color toner images are transferred and then the clear toner image is transferred so as to cover the color toner images (step S 108). The recording material S is subjected to the fixing step and then is outputted, so that the output product which is partly decreased in glossiness ((e) of FIG. 6 and (b) of FIG. 7) can be obtained.

3) The Case where Mixed Gloss Correction Key is Selected

When the mixed gloss correction key is selected on the panel screen shown in (a) of FIG. 5, the image formation is executed along an "MIXED MODE (FLOW)" shown in FIG. 4. In the "MIXED MODE", in the area designated so as to increase the gloss, the clear toner is formed on the lower side of the color toners. In the "MIXED MODE", in the area designated so as to decrease the gloss, the formation of the clear toner on the upper side of the color toners is determined (steps S103 and S104). On the basis of this determination, the controller K caused the first to sixth image forming portions Pa, Pb, Pc, Pd, Pe and Pf to perform the image forming operation. Then, on the recording material S, the image formation is effected in a manner such that the clear toner image is formed on the lower side of the color toner images and is effected in a manner such that the clear toner image is formed on the upper side of the color toner images (step S108). The recording material S is introduced into the fixing device 19, so that fixation of the color toner images and the clear toner image is effected.

In this image forming mode in the area designated so as to increase the gloss, at the sixth image forming portion Pf, the clear toner image is formed in the neighborhood of the recording material, i.e., on the lowermost layer side of the resultant toner images. Further, in the area designated so as to decrease the gloss, at the image forming portion Pa, the clear toner image is formed on the side in the neighborhood of the contact surface with the fixing roller 19*a* of the fixing device 19, i.e., the upper most surface layer side of the resultant toner images. Further, in this embodiment, the maximum total toner amount in the area in which the image formation is effected with only the color toners is 200%, and the maximum total toner amount which is the sum of the color toner amounts and the clear toner amount is 240%. However, the toner amount is not limited thereto. For example, in the case where the maximum total toner amount in the area in which the image formation is effected with only the color toners is 180%, the image formation may be effected so that the sum of the amounts per unit area of the color toners and the clear toner is 240% or less.

As an example, an image formation state is shown in (c) of FIG. 7. Incidentally, the image formation state described here is merely the example and thus the present invention is not limited thereto. An area A is a 190%-image area formed with only the color toners. An area B is an area, designated so as to partly increase the glossiness, in which a 50%-clear toner layer is formed on the lower side of the 190%-color toner layer and thus the total toner amount (per unit area) is 240%. The area C is an area, designated so as to partly decrease the glossiness, in which the 50%-clear toner layer is formed on the upper side of the 190%-color toner layer and thus the total toner amount (per unit area) is 240%. Here, in the area B which was intended to partly increase the glossiness and in the area C which was intended to partly decrease the glossiness, the total toner amount was set so as to be more than that in another area and was set at 240% in this case. In the areas B and C, the toner amount is set so that the color toner layer is 190% in toner amount per unit area and the clear toner layer is 50% in toner amount per unit area. That is, in the area intended to partly change the glossiness color toner amount per unit area is X1 (%) and the clear toner amount per unit area is X2 (%), X2 and X2 are set to satisfy: X1 +X2 =240 (trial calculation formula).

When the mixed gloss correction key is selected and the reading of necessary color information and gloss information is ended (step S101), the amounts of the color toners and the clear toner are determined on the basis of the trial calculation formula described above (step S 107). Then, the clear toner images and the color toner image are formed at the first to sixth As an example, an image formation state is shown in (c) of FIG. 7. Incidentally, the image formation state described here is merely the example and thus the present invention is not limited thereto. An area A is a 190%-image area formed with only the color toners. An area B is an area, designated so as to partly increase the glossiness, in which a 50%-clear toner layer is formed on the lower side of the 190%-color toner layer and thus the total toner amount (per unit area) is 240%. The area C is an area, designated so as to partly decrease the glossiness, in which the 50%-clear toner layer is formed on the upper side of the 190%-color toner layer and thus the total toner amount (per unit area) is 240%. Here, in the area B which was intended to partly increase the glossiness and in the area C which was intended to partly decrease the glossiness, the total toner amount was set so as to be more than that in another area and was set at 240% in this case. In the areas B and C, the toner amount is set so that the color toner layer is 190% in toner amount per unit area and the clear toner layer is 50% in toner amount per unit area. That is, in the area intended to partly change the glossiness color toner amount per unit area is X1 (%) and the clear toner amount per unit area is X2 (%), X2 and X2 are set to satisfy: X1 +X2 =240 (trial calculation formula).

When the mixed gloss correction key is selected and the reading of necessary color information and gloss information is ended (step S101), the amounts of the color toners and the clear toner are determined on the basis of the trial calculation formula described above (step S 107). Then, the clear toner images and the color toner image are formed at the first to sixth image forming portions Pa, Pb, Pc, Pd, Pe and Pf. Then, at the secondary transfer portion T2, onto the recording material S, the mixed gloss toner images are transferred. That is, the color toner images, the toner image including the upper side color toner images in the designated area and the lower side clear toner image in the designated area, the toner image including the lower side color toner images and the upper side clear toner image are transferred (step S 108). The recording material S is subjected to the fixing step and then is outputted, so that the output product which is partly increased in glossiness and is partly decreased in glossiness ((f) of FIG. 6 and (c) of FIG. 7) can be obtained.

In the glossing mode (FIG. 4) described above, the image formation with the clear toner for partly increasing, or partly decreasing, or partly increasing and partly decreasing the glossiness of the image to be outputted is partly effected in an image formable area of the recording material S.

(7) Relationship Between Melt Viscosity of Toner and Gloss

Here, the relationship between the melt viscosity of the toner and the gloss (glossiness) will be described with reference to schematic views. The gloss of the toner image of the output product is determined by the toner amount and the melted state of the toner in addition to surface smoothness of the fixing member (fixing roller) 19*a* of the fixing device 19, surface smoothness of the recording material, and the fixing condition such as the pressure or a speed.

The toner amount dependency of the gloss is noticeable in the case where the surface smoothness of the recording material is not high. This is because in the case where the toner amount is small, the gloss is liable to be influenced by the surface smoothness of the recording material. As shown in (a) and (b) of FIG. 8, in the case where the toner amount is small, when the toner is fixed on the recording material S, the gloss is liable to be influenced by the surface smoothness of the recording material S. However, as shown in (c) and (d) of FIG. 8, an uneven surface of the recording material S is filled with the toner when the toner amount is increased, so that the uppermost surface side of the image surface is less affected by the surface smoothness of the recording material. Therefore, under a condition in which the toner is sufficiently fixed, as shown in (e) of FIG. 8, the gloss is increased with an increasing toner amount. Further, the melted state of the toner is determined by the fixing condition such as the fixing temperature, the fixing speed or the pressure and by a viscosity characteristic of the toner under the fixing condition. That is, when a certain fixing condition, a degree of toner melting is higher with a lower toner viscosity, so that the gloss becomes high. On the other hand, in the case where the toner viscosity is high, the toner melting does not proceed and thus the gloss becomes low.

FIG. 9 shows a relationship among a position in the fixing nip N with respect to the recording material conveyance direction, the toner temperature at the position, and the melt viscosity of the toner at the toner temperature. Incidentally, the toner temperature was measured by applying a thermocouple (Type K Fine and Sheet thermocouple "KFST-10-100-200", mfd. by AMBE SMT Co.) onto the recording material, and a distribution of pressure was measured by using a tactile sensor ("Sealer", mfd. by NITTA Corp.). The melt viscosity of the toner was measured by using an elevated flowtester ("CFT-100", mfd. by Shimadzu Corp.). A sample, of 1.0 g in weight, molded by using a pressure molding device was extruded from a nozzle of 1 mm in diameter and 1 mm in length while applying a load of 20 kgf by a plunger at a temperature rise ratio of 5.0 ° C/min, so that a lowering amount of the plunger of the flowtester was measured. As is understood from FIG. 9, in the nip N, the toner temperature is gradually increased and is highest at the recording material exit of the nip N. For example, in the nip N, at the time when the toner temperature reaches 90 ° C., a corresponding toner viscosity is $1\times10^5$ Pa·s. At the recording material exit of the nip N, the toner temperature reaches 120 ° C., the toner viscosity at this time is $1\times10^3$ Pa·s. Thus, the toner viscosity is changes in the nip N, and the gloss value varies depending on whether the toner viscosity is high or low. When the color toner and the clear toner used in this embodiment are compared, as shown in (b) of FIG. 3, the viscosity of the clear toner is always higher than the viscosity of the color toner with respect to the fixing temperature, so that the glossiness of the clear toner is lower than that of the color toner.

On the other hand, the melted state of the toner which contributes to the gloss depends on the surface layer side of the toner image more than the lower side of the toner image. That is, e.g., even in the case where the melted state of the toner image on the lowermost layer side is not good ("MELT STATE: LOW"), when the melted state on the uppermost surface layer side is good "MELT STATE: HIGH") and a smooth surface is formed, the gloss itself is high ((a) of FIG. 10). On the other hand, even in the case where the melted state of the toner image on the lowermost layer side is high, when the uppermost surface side smoothness is low, the gloss is low ((b) of FIG. 10). Therefore, when the viscosity of the toner image on the uppermost surface layer side where the toner image contacts the fixing member is high, the melted state is not good and thus the gloss is low. On the other hand, when the viscosity of the toner image on the uppermost surface layer side is low, the melted state is good and thus the gloss is high.

This embodiment is characterized in that the gloss is decreased so as to be lower than that at the color toner portion by forming the clear toner (layer) on the color toner (layer). That is, the clear toner used in this embodiment is higher in melt viscosity than the color toner ((b) of FIG. 3). For that reason, when the color toner on the fixing member side (on the uppermost surface layer side of the toner image) and the clear toner are compared, the color toner is higher in gloss and the clear toner is lower in gloss. As shown in (c) of FIG. 10, when an image surface (area A) of only the color toner and an image surface (area C) where the clear toner is placed on the color toner are compared, in the neighborhood of the image surface, the viscosity with respect to the temperature is different therebetween. For that reason, a difference in gloss, i.e., "AREA A: GLOSS-HIGH" and "AREA C: GLOSS-LOW" are caused.

As described above, the color toner and the clear toner used in this embodiment possess the melt viscosity characteristics as shown in (b) of FIG. 3. That is, in an operating temperature range, the melt viscosity η (Pa·s) at a temperature T (° C.) satisfies the following relationships:

$$\eta color(T)<\eta clear(T),$$

wherein ηcolor (T) is the melt viscosity of the color toner at T ° C., and ηclear (T) is the melt viscosity of the clear toner at T ° C.

It is desirable that the gloss can be effectively controlled by this relationship of the melt viscosity characteristic. However, e.g., in the case where the toners are used in a temperature range higher than that used in this embodiment, the effect of the gloss control cannot be sufficiently obtained in some instances. For example, even when the above relationship is satisfied, the clear toner portion is higher in gloss than the color toner portion in some cases. Examples of the cases may include a state in which the color toner portion is excessively melted and therefore the gloss is not increased further, and a state in which the image is deteriorated at the color toner portion due to a high-temperature offset phenomenon or the like. The gloss (glossiness) of each of the color toner and the clear toner used in this embodiment shows a temperature characteristic as shown in FIG. 11. That is, the color toner shows a maximum of the gloss at the toner temperature of about 140° C. and the gloss tends to be lowered in a temperature range of more than 140° C. This is because the high-temperature offset phenomenon as described above occurs. However, the clear toner has the higher melt viscosity and therefore is increased in gloss up to a certain temperature even in the temperature range in which the color toner causes the high-temperature offset phenomenon. For this reason, in the temperature range of 140° C. or more, the gloss at the color toner portion can be lower than the gloss at the clear toner portion. In the temperature range in which the color toner does not cause the high-temperature offset phenomenon, i.e., at not more than the melt viscosity of the color toner at about 140° C., it is preferable that the image is formed and fixed.

Further, in the case where the toners are used in the temperature range lower than that used in this embodiment, a phenomenon that the toner image is not fixed on the recording material S, i.e., a so-called low-temperature offset phenomenon also occurs. In this embodiment, the clear toner used has the melt viscosity higher than that of the color toner used and therefore the low-temperature (side) offset phenomenon is liable to occur with respect to the clear toner. In the fixation constitution used in this embodiment, in the case where the toner is used at the melt viscosity of $2\times10^5$ (Pa·s) or more, the low-temperature offset phenomenon occurs.

Therefore, the above-described melt viscosity relationship is important in the temperature range in which a preferred image quality is obtained. In this embodiment, in the temperature range of about 100 ° C. to about 140 ° C. with respect to the toner temperature in the fixing nip N, the melt viscosities may more preferably satisfy the relationship.

$$2\times10^5>\eta clear(100)>\eta color(100)$$

$$2\times10^2>\eta color(140)<\eta clear(140)$$

Then, the case where the color toner is formed (provided) on the upper side of the clear toner will be described. In the area in which the color toner is formed on the upper side of the clear toner, the total toner amount itself is larger than that at the color toner portion. In this case, the gloss is increased with the increasing toner amount per unit area as described above, so that the gloss at the image surface on which the color toner and the clear toner are placed is higher than that at the image surface on which only the color toner is placed.

However, in this case, it was found that the gloss is increased in an amount which is not less than the gloss change amount depending on the total toner amount. That is, it was found that when the total toner amount (per unit area) of the color toner is A, the gloss at that time is GA, the some sum of the toner amount per unit area of the clear toner and the toner amount per unit area of the color toner is B, the gloss at that time is GB, and A=B, the relationship of GA<GB is satisfied. With respect to this phenomenon, as a result of observation of the output product through a laser microscope ("VK8000", series, mfd. by KEYENCE Corp.), it was found that the toner melted state was a state as described below. The state will be described with reference to the drawings.

Parts (a) to (d) of FIG. 12 illustrate a melting process of the color toner only, and parts (a) to (d) of FIG. 13 illustrate the melting process in the case where the clear toner is located under the color toner. Part (a) of FIG. 12 shows a state of the unfixed color toner on the recording material S, (b) is a partly enlarged view of (a) of FIG. 12, (c) is a state in which the toner is melted from the state of (b), and (d) is a schematic view of a state of the toner image surface on the recording material in the case where the unfixed color toner is melt-fixed. Part (a) of FIG. 13 shows a state of the unfixed toner image including the upper side color toner (layer) and the lower side clear toner (layer). Part (b) is a partly enlarged view of (a) of FIG. 13, (c) is a state in which the toner is melted from the state of (b), and (d) is a schematic view of a state of the toner image surface on the recording material in the case where the unfixed color toner including the upper side color toner (layer) and the lower side clear toner (layer) is melt-fixed.

As shown in FIG. 12, in the case where the toner having a certain melt viscosity is melted with respect to a certain toner amount, the lowermost layer side toner is extended widely and the toner surface of the image surface on the uppermost surface side liable to be influenced by the surface state of the recording material, so that the gloss is liable to lower. On the other hand, as shown in FIG. 13, in the case where the toner having the higher melt viscosity is present on the lower toner layer side, the extension (diffusion) of the toner on the lower toner layer side is suppressed and therefore the toner surface of the image surface on the uppermost surface side is less affected by the surface state of the recording material, so that the gloss of the toner on the image surface side is increased.

(8) Verification Experiment 1

A verification experiment on the change in gloss by a difference of the order of formation (provision) of the clear toner was conducted. The verification was made with respect to two types of the recording material S including plain paper (paper gloss of about 6%) having basis weight of 80 g/m$^2$ and gloss coated paper (paper gloss of 30%) having basis weight of 128 g/m$^2$. With respect to the plain paper used for the verification, the process speed was 200 mm/sec and the control temperature (fixing temperature) of the fixing device 19 was 180° C. Further, with respect to the coated paper, the process speed was 100 mm/sec and the control temperature of the fixing device 19 was 180° C. As the toners, the color toner and the clear toner which had the melt viscosity characteristic shown in (b) of FIG. 3 were used.

In the verification in this embodiment, color images of three levels of the color toner amount of 60%, 120% and 180% were used. With respect to these color images, the glossing effect was compared in the following cases 1), 2) and 3).

1) The case where 60%-clear toner is not formed (normal color image which is not subjected to the gloss correction), 2) The case where 60%-clear toner is formed on the lower side of the color toner (color image which has been subjected to the gloss-up correction), and 3) The case where 60%-clear toner is formed on the upper side of the color toner (color image which has been subjected to the gloss-down correction). The values of glossiness (%) of each of the color images as described above on the output products are shown in Table 1 and (a) of FIG. 15.

TABLE 1

| Glossing effect on plain paper | | | |
|---|---|---|---|
| Color image | *1 None (%) | *2 Upper (%) | *3 Lower (%) |
| 60% color | 8.9 | 7.0 | 12.9 |
| 120% color | 12.0 | 9.1 | 16.4 |
| 180% color | 14.9 | 11.5 | 20.3 |

*1: No clear toner was provided.
*2: The clear toner was provided on the upper side of the color toner.
*3: The clear toner was provided on the lower side of the color toner.

As described above, it is understood that the gloss (glossiness) can be made lower than that in the area, in which no clear toner was provided, by providing the clear toner on the upper side of the color toner. Further, it is understood that the gloss can be made higher than that in the area, in which no clear toner was provided, by providing the clear toner on the lower side of the color toner.

By using the constitution described above, in the image forming apparatus in which the image is formed by the color toners and the clear toner and then is fixed, it is possible to obtain the output product which has been subjected to wide-ranging glossiness control by using a single species of the clear toner without lowering productivity. That is, it is possible to obtain the output product including the area partly decreased in glossiness compared with the glossiness of adjacent area, or including the area partly increased in glossiness compared with the glossiness of adjacent area, or including both of these areas in mixture.

<Embodiment 2>

(1) Mixed Gloss Mode

In this embodiment, the description will be made with respect to control capable of providing variations in level of an increase in gloss or a decrease in gloss in the case where the mixed gloss correction key ((a) of FIG. 5) described in Embodiment 1 is selected. Incidentally, the image forming apparatus used is similar to that used in Embodiment 1. Further, in the following, as the gloss designation image, the case where it is discriminated and designated as a certain area will be described as an example but a similar operation is performed also in the case where it is discriminated and designated as the character information or the object such as color information as described with reference to (a) to (f) of FIG. 6.

The image formation of the color toner image and the clear toner image and the fixing step in the case where the mixed gloss correction key is selected will be described below. Incidentally, also in this embodiment, similarly as in Embodiment 1, the case where the glossing mode selection key is selected on the panel 406 of the operation display portion B in the copy mode will be described in detail. A similar operation is performed also in the case where the glossing signal is sent from the external host device 1000 in the printer mode.

In this embodiment, the case where an image including gloss information as shown in, e.g., (a) of FIG. 14 is outputted will be described. Incidentally, in (a) of FIG. 14, the gloss designation image is discriminated and designated as a certain area but a similar operation is performed also in the case where it is designated as the character information or the object such as color information. An area A is an area in which only the color toner image is formed. An area B and an area D are an area in which the gloss higher than that of the area A is designated. In the area B, the gloss is designated at a level higher than that in the area D. Further, an area C and an area E are an area in which the gloss lower than that of the area A is designated. In the area C, the gloss is designated at a level lower than that in the area E. That is, the glossiness information in each of the above areas is as follows.

area *B*>area *D*>area *A*>area *E*>area *C*

Incidentally, in this embodiment, the description will be made with respect to image output with a difference in glossiness of 5 levels but the present invention is not limited thereto.

When the mixed gloss correction button (key) is selected ((a) of FIG. 5) similarly as in Embodiment 1, as shown in (d) of FIG. 5, a screen for designating that the color original is read (by the original reading portion A) is displayed on the panel 406. Then, the color original O shown in (b) of FIG. 14 is placed on the original reading portion A and the OK button on the screen shown in (d) of FIG. 5 is pressed, so that the reading of the color original is executed and completed. Then, as shown in (e) of FIG. 5, a screen for designating that the gloss original for gloss up is read is displayed. Then, the gloss-up designation image original Ou shown in (c) of FIG. 14 is placed and then, the reading of the gloss information for gloss-up is executed by pressing the OK button on the screen shown in (e) of FIG. 5 and is then completed. At this time, a degree of the increase in gloss in the area B and the area D can be adjusted, e.g., by reading the degree as the density information of the image in each of the area B and the area D. That is, the variation (degree) of the gloss in a certain area is recognized as the density difference. Then, as shown in (f) of FIG. 5, a screen for designating that the gloss original for gloss down is read is displayed. Then, the gloss-down designation image original Od shown in (c) of FIG. 14 is placed and then, the reading of the gloss information for gloss down is executed by pressing the OK button on the screen shown in (f) of FIG. 5 and is then completed. At this time, a degree of the decrease in gloss in the area E and the area C can be adjusted, e.g., by reading the degree as the density information of the image in each of the area E and the area C. That is, the variation (degree) of the gloss in a certain area is recognized as the density difference.

By performing the operation as described above, the controller (portion) K obtains the image information of each of the colors of C, M, Y and K and the gloss information of clear (Cl). Then, as shown in (a) of FIG. 14, it becomes possible to obtain the image (area A in which the areas D and B partly increased in gloss at multi-levels and the areas E and C partly decreased in gloss at multi-levels are co-present.

Further, in the printer mode, the image (data) intended to be outputted is prepared by the personal computer (PC) which is the external host device 1000 by using an image software capable of processing the clear image or the gloss information. Then, on the basis of the prepared image data, at an RIP (raster image processor) portion, the prepared image data is converted into image information of each of the colors of C, M, K and Cl. At this time, whether the gloss of the prepared gloss designating area image is increased or decreased can be designated by the software at multi-levels. The image data converted into the image information of each color is converted into image information corresponding to that for output equipment by a printer driver and is sent as an electric signal to the main assembly of the image forming apparatus, so that, as shown in (a) of FIG. 14, it becomes possible to obtain the image partly different in glossiness at the multi-levels.

(2) Image Formation and Fixing Step

The image formation and the fixing step of the color toners and the clear toner in the case where the mixed gloss correction key ((a) of FIG. 5) is selected in this embodiment will be described.

Similarly as in Embodiment 1, when the mixed gloss correction key is selected, the controller K causes the clear toner formation (provision) order determination means to determine formation of the clear toner on an upper side or a lower side of the color toners. That is, in the area B or D designated so as to increase the gloss, the formation of the clear toner on the lower side of the color toners is determined. In the area C or E designated so as to decrease the gloss, the formation of the clear toner on the upper side of the color toners is determined. Then, the image formation of the color toner images at the second to fifth image forming portions Pb, Pc, Pd and Pe and the image formation of the clear toner images at the first and sixth image forming portions Pa and Pf are effected. The recording material S is introduced into the fixing device 19, so that fixation of the color toner images and the clear toner images is effected.

At this time, in the area B or D designated so as to increase the gloss, the clear toner image is formed at the sixth image forming portion Pf to effect the image formation in the neighborhood of the recording material, i.e., on the lowermost layer side of the resultant toner images. At this time, in the area C or E designated so as to decrease the gloss, the clear toner image is formed at the first image forming portion Pa to effect the image formation on the side in the neighborhood of the contact surface with the fixing member, i.e., on the uppermost surface layer side of the resultant toner images. Further, in this embodiment, the maximum total toner amount in the area in which the image formation is effected with only the color toners is 200%, and the maximum total toner amount which is the sum of the color toner amounts and the clear toner amount is 240%. However, e.g., in the case where the maximum total toner amount in the area in which the image formation is effected with only the color toners is 180%, the image formation may be effected so that the sum of the amounts per unit area of the color toners and the clear toner is 240% or less.

As an example, the case where the image including the glossiness information as shown in (a) of FIG. 14 is outputted will be described. Incidentally, the image formation state described here is merely the example and thus the present invention is not limited thereto. The area A is a 180%-image area formed with only the color toners. The area B is an area, designated so as to partly increase the glossiness, in which a 180%-color toner layer is formed on the upper side of the toner image and the 60%-clear toner layer is formed on the lower side of the toner image surface and thus the total toner amount (per unit area) is 240%. The area D is an area, designated so as to partly increase weakly the glossiness, in which the 180%-color toner layer is formed on the upper side of the toner image surface and a 20%-clear toner layer is formed on the lower side of the toner image surface and thus the total toner amount is 200%. The area C is an area, designated so as to partly decrease the glossiness, in which the 180%-color toner layer is formed on the lower side of the toner image surface and a 60%-clear toner layer is formed on the upper side of the toner image surface and thus the total toner amount is 240%. The area E is an area, designated so as to partly decrease weakly the glossiness, in which the 180%-color toner layer is formed on the lower side of the toner image surface and the 20%-clear toner layer is formed on the upper side of the toner image surface and thus the total toner amount is 200%.

When the mixed gloss correction key ((a) of FIG. 5) is selected and the reading of necessary color information and gloss information is ended, the amounts of the color toners and the clear toner are determined as described above. Then, when the image formation with the color toners and the clear toner is effected, the toner images including the color toner layer and the clear toner layer are formed on the recording material as shown in (a) of FIG. 14 and are subjected to the fixing step, so that it is possible to obtain the output product which is partly changed in glossiness.

(3) Verification Experiment 2

A verification experiment on the change in gloss by a difference of the amount of formation (provision) of the clear toner was conducted. The fixing device, the recording material and respective conditions of the toners are similar to those in Verification 1 in Embodiment 1.

In the verification in this embodiment, the color image used had the color toner amount of 180%. With respect to these color images, the glossing effect was compared in the following cases 1), 2) and 3).

1) The case where the clear toner is not formed (normal color image which is not subjected to the gloss correction),
2) The case where the clear toner is formed in the amounts of 20%, 40% and 60% on the lower side of the color toner (color image which has been subjected to the gloss-up correction), and
3) The case where the clear toner is formed in the amounts of 20%, 40% and 60% on the upper side of the color toner (color image which has been subjected to the gloss-down correction). The values of glossiness (%) of each of the color images as described above on the output products are shown in Table 2 and (b) of FIG. 15.

TABLE 2

| Glossing effect on plain paper | | | |
|---|---|---|---|
| Clear image | *1 None (%) | *2 Upper (2) | *3 Lower (%) |
| 20% clear | 14.9 | 14.1 | 17.5 |
| 40% color | 14.9 | 13.5 | 18.1 |
| 60% color | 14.9 | 11.5 | 20.3 |

*1: No clear toner was provided.
*2: The clear toner was provided on the upper side of the color toner.
*3: The clear toner was provided on the lower side of the color toner.

As described above, the gloss (glossiness) can be made lower than that in the area, in which no clear toner was provided, by providing the clear toner on the upper side of the color toner. Further, it is understood that the degree of the decrease in glossiness can be adjusted by changing the amount of formation of the clear toner. Further, it is understood that the gloss can be made higher than that in the area, in which no clear toner was provided, by providing the clear toner on the lower side of the color toner. Further, it is understood that the degree of the increase in glossiness can be adjusted by changing the amount of formation of the clear toner.

As described above, the control means K changes the amount per unit area of the clear toner on the recording material S depending on the level of the increase or decrease in glossiness.

By using this constitution, in the image forming apparatus in which the image is formed by the color toners and the clear toner and then is fixed, it is possible to obtain the output product which has been subjected to wide-ranging glossiness control.

<Other Embodiments>

1) In Embodiments 1 and 2, the partly glossing mode in the case of the four-color based full-color image formation is described but a similar effect can be obtained by applying the partly glossing mode as described above to the case of the single color image formation such as the monochromatic image formation.
2) The image forming apparatus is not limited to that of the intermediary transfer type. It is also possible to employ an apparatus constitution in which a full-color or single-color toner image and a clear toner image are formed on the recording material in a determined order of formation by using a transfer method or a direct transfer method while conveying the recording material held on a conveyer belt or a transfer drum to the image forming portions and then the recording material is introduced into the fixing device.
3) The toner image forming process is not limited to the electrophotographic type but may also be an electrostatic recording process using an electrostatic dielectric member as the image bearing member and a magnetic recording process using a magnetic recording (magnetic) material.
4) The fixing means is not limited to the fixing device of the heat roller type in this embodiment but may also be a belt fixing device using a belt member (or film) as either one or both of the fixing member and the pressing member and a fixing device of a non-contact type in which the toner is heat-fixed by irradiating infrared rays or high-frequency radiation.

In Embodiments 1 and 2, the case where the toner images are formed on the plurality of photosensitive members (so-called tandem type) is described as the example. The present invention is also applicable to an image forming apparatus of the type in which the toner images are formed on a single photosensitive member (so-called rotary type).

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 011753/2010 filed Jan. 22, 2010, which is hereby incorporated by reference.

What is claimed is:

1. An image forming apparatus comprising:

a color toner image forming portion configured to form a color toner image on a sheet using color toner;

a transparent toner image forming portion configured to form a transparent toner image on the sheet using transparent toner which has, within a heating temperature range usable in said apparatus, a melt viscosity higher than that of the color toner;

a fixing portion configured to fix a toner image formed on the sheet by said color toner image forming portion and said transparent toner image forming portion by heat and pressure;

an obtaining portion configured to obtain information relating to a designated area of the color toner image and whether a glossiness of the designated area is to be partly increased or partly decreased using the transparent toner; and a controlling portion configured to control said transparent toner image forming portion based on the obtained information by said obtaining portion, wherein when the glossiness of the designated area is to be partly increased based on the obtained information, the transparent toner image is positioned directly on a surface of the sheet and the color toner image is positioned on the transparent toner image, in the designated area, due to control by said controlling portion, and wherein when the glossiness of the designated area is to be partly decreased based on the obtained information, the transparent toner image is positioned on the color toner image formed on the surface of the sheet, in the designated area, due to control by said controlling portion.

2. An apparatus according to claim 1, further comprising an intermediary transfer member configured to transfer the toner image, which is formed by said color toner image forming portion and said transparent toner image forming portion, onto the sheet, wherein when the glossiness of the designated area is to be partly increased based on the obtained information, the transparent toner image is lastly formed on said intermediary transfer member, due to control by said controlling portion.

3. An apparatus according to claim 2, wherein when a level of the glossiness of the designated area of which is to be partly increased is variable, said controlling portion controls an amount per unit area of the transparent toner on the sheet in the designated area based on the level of the glossiness.

4. An apparatus according to claim 1, further comprising an intermediary transfer member configured to transfer the toner image, which is formed by said color toner image forming portion and said transparent toner image forming portion, onto the sheet, wherein when the glossiness of the designated area is to be partly decreased based on the obtained information, the transparent toner image is firstly formed on said intermediary transfer member, due to control by said controlling portion.

5. An apparatus according to claim 4, wherein when a level of the glossiness of the designated area of which is to be partly decreased is variable, said controlling portion controls an amount per unit area of the transparent toner on the sheet in the designated area based on the level of the glossiness.

6. An apparatus according to claim 1, further comprising an intermediary transfer member configured to transfer the toner image, which is formed by said color toner image forming portion and said transparent toner image forming portion, onto the sheet, wherein when the glossiness of the designated area is to be partly increased based on the obtained information, the transparent toner image is lastly formed on said intermediary transfer member, due to control by said controlling portion, and wherein when the glossiness of the designated area is to be partly decreased based on the obtained information, the transparent toner image is firstly formed on said intermediary transfer member, due to control by said controlling portion.

7. An apparatus according to claim 6, wherein when a level of the glossiness of the designated area of which is to be partly increased is variable, said controlling portion controls an amount per unit area of the transparent toner on the sheet in the designated area based on the level of the glossiness, and wherein when a level of the glossiness of the designated area of which is to be partly decreased is variable, said controlling portion controls an amount per unit area of the transparent toner on the sheet in the designated area based on the level of the glossiness.

8. An apparatus according to claim 1, wherein when a level of the glossiness of the designated area of which is to be partly increased is variable, said controlling portion controls an amount per unit area of the transparent toner on the sheet in the designated area based on the level of the glossiness.

9. An apparatus according to claim 1, wherein when a level of the glossiness of the designated area of which is to be partly decreased is variable, said controlling portion controls an amount per unit area of the transparent toner on the sheet in the designated area based on the level of the glossiness.

10. An apparatus according to claim 1, wherein when said obtaining portion obtains the information relating to a first designated area and a second designated area of the color toner image, and a glossiness of the first designated area is to be partly increased and a glossiness of the second designated area is to be partly decreased using the transparent toner, a first transparent toner image is positioned directly on a surface of the sheet and the color toner image is positioned on the first transparent toner image in the first designated area, due to control by said controlling portion, and a second transparent toner image is positioned on the color toner image formed on the surface of the sheet in the second designated area, due to control by said controlling portion.

11. An apparatus according to claim 10, further comprising an intermediary transfer member configured to transfer the toner image, which is formed by said color toner image forming portion and said transparent toner image forming portion, onto the sheet, wherein in the first designated area, the transparent toner image is lastly formed on said intermediary transfer member, due to control by said controlling portion, and wherein in the second designated area, the transparent toner image is firstly formed on said intermediary transfer member, due to control by said controlling portion.

12. An apparatus according to claim 10, wherein when a level of the glossiness of the first designated area is variable, said controlling portion controls an amount per unit area of the transparent toner on the sheet in the first designated area based on the level of the glossiness, and wherein when a level of the glossiness of the second designated area is variable, said controlling portion controls an amount per unit area of the transparent toner on the sheet in the second designated area based on the level of the glossiness.

* * * * *